US008282438B2

(12) United States Patent
Tamulewicz et al.

(10) Patent No.: US 8,282,438 B2
(45) Date of Patent: Oct. 9, 2012

(54) PLAYSET SYSTEM FOR TOY VEHICLES

(75) Inventors: Steven C. Tamulewicz, Phoenix, AZ (US); Paul A. Tamulewicz, Berea, OH (US)

(73) Assignee: Ditropolis, Inc., Glendale, AZ (US)

( * ) Notice: Subject to any disclaimer, the term of this patent is extended or adjusted under 35 U.S.C. 154(b) by 299 days.

(21) Appl. No.: 12/384,694

(22) Filed: Apr. 8, 2009

(65) Prior Publication Data

US 2010/0258646 A1 Oct. 14, 2010

(51) Int. Cl.
*A63H 33/26* (2006.01)

(52) U.S. Cl. ..... 446/129

(58) Field of Classification Search ..... 446/129, 446/445–452, 92, 137
See application file for complete search history.

(56) References Cited

U.S. PATENT DOCUMENTS

| | | | | |
|---|---|---|---|---|
| 2,562,623 | A * | 7/1951 | Levering | 238/10 R |
| 3,025,626 | A | 3/1962 | Schumacher | |
| 3,579,904 | A | 5/1971 | Genin | |
| 3,643,865 | A | 2/1972 | Mutz et al. | |
| 4,091,561 | A | 5/1978 | Kimura | |
| 4,101,131 | A | 7/1978 | Barnby | |
| 4,235,371 | A * | 11/1980 | Kohler | 238/382 |
| D265,220 | S | 6/1982 | Orenstein | |
| 4,504,012 | A | 3/1985 | Fetty et al. | |
| 4,569,527 | A | 2/1986 | Rosenwinkel et al. | |
| D309,646 | S | 7/1990 | Halbert | |
| 4,953,786 | A | 9/1990 | Arsenault | |
| 5,000,715 | A | 3/1991 | Johnson | |
| 5,002,513 | A | 3/1991 | Weiss | |
| 5,021,021 | A * | 6/1991 | Ballard | 446/92 |
| 5,326,267 | A | 7/1994 | Brokaw | |
| 5,336,498 | A * | 8/1994 | Snider | 424/402 |
| 6,056,619 | A | 5/2000 | Wiggs et al. | |
| 6,193,581 | B1 | 2/2001 | Wiggs et al. | |
| 6,227,931 | B1 | 5/2001 | Shackelford | |
| 6,322,415 | B1 | 11/2001 | Cyrus et al. | |
| 6,328,500 | B1 | 12/2001 | Rubio | |
| 6,431,936 | B1 * | 8/2002 | Kiribuchi | 446/92 |
| 6,464,223 | B2 | 10/2002 | Rutter | |
| 6,908,396 | B1 * | 6/2005 | Billig | 472/85 |
| 7,364,487 | B2 | 4/2008 | Evans et al. | |
| 2006/0128259 | A1 | 6/2006 | Whitehead | |
| 2006/0147893 | A1 * | 7/2006 | Moore et al. | 434/430 |
| 2006/0196384 | A1 * | 9/2006 | Faulcon | 104/60 |
| 2007/0087651 | A1 * | 4/2007 | Ali | 446/137 |

FOREIGN PATENT DOCUMENTS

| | | |
|---|---|---|
| GB | 2 090 146 | 7/1982 |
| WO | WO 2007/026277 | 3/2007 |

* cited by examiner

*Primary Examiner* — Gene Kim
*Assistant Examiner* — Amir Klayman
(74) *Attorney, Agent, or Firm* — Hudak, Shunk & Farine, Co. LPA

(57) ABSTRACT

A playset system for toy vehicles, preferably wheeled toy vehicles, the playset system having multiple levels including a base level, having one or more and preferably two or more base segments that are interconnectable; and a roadway level having one or more and preferably two or more segments that are interconnectable, wherein the roadway level is located on an upper surface of the base level. In a preferred embodiment, the playset system is specifically designed and scaled to accommodate die cast vehicles, preferably 1:64 scale die cast vehicles that are known in the art. The playset in preferred embodiments utilizes magnetic fields to operatively connect the components of the base level to components of the roadway level.

24 Claims, 30 Drawing Sheets

PLAYSET SYSTEM FOR TOY VEHICLES

FIELD OF THE INVENTION

The present invention relates to a playset system for toy vehicles, preferably wheeled toy vehicles, the playset system having multiple levels including a base level, having one or more and preferably two or more base segments that are interconnectable; and a roadway level having one or more and preferably two or more segments that are interconnectable, wherein the roadway level is located on an upper surface of the base level. In a preferred embodiment, the playset system is specifically designed and scaled to accommodate die cast vehicles, preferably 1:64 scale die cast vehicles that are known in the art. The playset in preferred embodiments utilizes magnetic fields to operatively connect the components of the base level to components of the roadway level.

BACKGROUND OF THE INVENTION

Various play surfaces, sets and items have been designed for use with toy vehicles and more specifically toy die cast vehicles. Examples of play surfaces, sets and items are set forth in U.S. Pat. Publication Nos. D265220; D309646; U.S. Pat. Nos. 3,025,626; 3,579,904; 3,643,865; 4,091,561; 4,101,131; 4,504,012; 4,569,527; 4,953,786, 5,000,715; 5,002,513; 5,326,267; 6,056,619; 6,193,581; 6,227,931; 6,322,415; 6,328,500; 6,464,223; 7,364,489; 2006/0128259; GB 2090146 and WO 2007/026277. In several of these known arrangements, roadways and dioramas are printed directly onto the play surface and offer little in the way of realism as one might find, for instance, in some model railroading arrangements. Additionally, graphic representations that are printed in such arrangements often tend to be stylized and out of scale with that of toy die cast vehicles.

Other play sets more specific to toy die cast vehicles have been known. Some of these sets utilize the easy spinning wheel designs found on these vehicles, and provide a guided track that cradles the wheels and is assembled in various configurations that allow for a multitude of high speed stunt tricks and maneuvers. Some of the aforementioned sets also utilize a motorized drive wheel device in which the vehicles are passed through and shot down the assembled track. While these sets offer play value, they fail to possess a true sense of realism that would appeal to a play pattern more focused on the imagination of children and collectors alike.

Some of the prior art play surfaces, sets and items incorporate magnetism in their constructions.

U.S. Patent Application Publication No. 2006/0128259 relates to the provision of a playmate and also a toy which includes a playmate and articles to be placed thereon in play. The play mat includes at least a portion, more typically a layer, of a magnetic or magnetically attractive material such as a metalized compound. The articles include magnetic or magnetically attractive material therein such that when the child brings the article into proximity with the playmate, a magnetic field is created which acts to retain the article in position where placed by the child. The article is retained at that location until the child exerts a movement force on the article to overcome the magnetic force.

U.S. Pat. No. 7,364,487 relates to a structure building system that utilizes a mat, a set of connectors and a set of structural members to build a structure. In a preferred embodiment, magnetic coupling/connection may be used to connect the piece of the structure together. The system may also have one or more pieces of material that may be draped over the structure.

International Application No. WO 2007/026277 relates to a magnetic display apparatus comprising a playing surface, a plurality of magnetic field emitting elements adapted to generate a spatially varying magnetic field across the surface and one or more moveable objects, adapted to sense and react to magnetic field levels across the surface.

Great Britain Patent Application 2 090 146 relates to a table mat that has on one or both surfaces the markings of a playing area for a game. Playing pieces are removably secured to the playing area by magnetic attraction. The mat has a depth greater than the thickness of a playing piece and at least one recess in which the playing pieces can be stored.

SUMMARY OF THE INVENTION

In view of the above, it would be desirable to provide a playset system that can be assembled in various configurations which aids in maintaining interest in the system.

An object of the present invention is to provide a playset system with a base level comprising a base mat having an upper surface and a lower surface with a side surface located therebetween, the base mat comprising one or more of a plurality of magnetic elements and magnetically attractable elements through which two or more roadway segments are connectable to the base mat via magnetic attraction.

Still a further object of the present invention is to provide the base level with a plurality of base mats each having an upper surface and a lower surface, each base mat having three or more side surfaces between the upper surface and lower surface and a roadway segment having a lower surface that is magnetically attracted to one or more of the first and second base mats through magnetic attraction.

Yet another object of the present invention is to provide a realistic, novel play system that in one embodiment is specifically scaled to 1:64 size to match existing toy die cast vehicles, that promotes imaginative play and presentation.

Another object of the current invention is to provide a play system with road sections that can be assembled and reassembled in numerous configurations.

A further object of the invention is to provide a multitude of realistic accessories to include, but not limited to, buildings, services, social infrastructures and natural features that promote play with vehicle interaction.

Still a further object of the current invention is to accommodate all play ages with design by adhering to guidelines established for juvenile toys while maintaining higher levels of detail and mature appeal.

According to the present invention, there is a realistic play system, in one embodiment specifically scaled 1:64 size, that accommodates toy die cast vehicles. In a preferred embodiment, the play system comprises a magnetized playing base surface or mat, road sections of various configurations that form a roadway, and a host of different building structures, roadway structures and supporting natural and/or man made accessories similar to that found in all settings of everyday life. Components of the play system to be placed on the magnetized playing base surface feature positioning elements that are attracted to the surface to provide a positive footing and make them more resistant to falling over if the surface is moved or bumped. In addition, all said components preferably feature a high degree of realism, surface texture and detail to most accurately depict the item they are designed to represent.

In one aspect of the present invention, a playset system with multiple configuration possibilities is disclosed, comprising a base mat having a length and a width, the base mat having an upper surface and a lower surface adapted to be disposed on a substrate, the base mat comprising one or more of a plurality of magnetic elements and magnetically attractable elements, and two or more roadway segments each having an upper surface, a lower surface and a side surface located between the upper surface and lower surface, the lower surface including one or more of a plurality of magnetic elements and magnetically attractable elements, wherein the two or more roadway segments are connectable to the base mat via magnetic attraction with the lower surface of the two or more roadway segments being magnetically connectable to the upper surface of the base mat, wherein the side surfaces of the two or more roadway segments are abuttable to provide continuity between road features of the two or more roadway segments, and wherein the length and width of the base mat form an area greater than an area of at least two of the roadway segments.

In another aspect of the present invention, a playset system with multiple configuration possibilities is disclosed, comprising a first base mat and a second base mat each having a length and a width, each base mat having an upper surface and a lower surface, each lower surface adapted to be disposed on a substrate, each base mat having three or more side surfaces between the upper surface and the lower surface, the first base mat having a side surface having a length substantially equal to a length of a side surface of the second base mat and a connector element connectable to said substantially equal length side surfaces, each base mat comprising one or more of a plurality of magnetic elements and magnetically attractable elements in operative contact with the upper surface of the base mat, and a first roadway segment and a second roadway segment, each having an upper surface and a lower surface, the lower surface of the first and second roadway segments including one or more of a plurality of magnetic elements and magnetically attractable elements, wherein the first and second roadway segments are connectable to the first and second base mats through magnetic attraction, wherein the first roadway segment has a side surface matable with a side surface of the second roadway segment to provide continuity between roadway features of the first and second roadway segments.

In still another aspect of the present invention, a playset system for toy vehicles is disclosed, comprising a plurality of magnetic base mats of geometric shapes having at least one side surface having a common length or a length divisible to the common length to allow for the mats to be contiguously placed in a multitude of configurations, at least one side surface of each mat including at least one aperture therein, a plurality of coupler components, each component having a middle stop and a barbed peg receivable in said aperture, whereby inserted into each recess, the component serves to interlock two of the base mats, a plurality of roadway segments having a common side surface profile, the roadway segment having at least one positioning disc substantially flush to a bottom surface of the roadway segment, whereby allowing for placement of the roadway segments on the base mats in a multitude of end to end configurations while securing the roadway segment to the base mats with magnetization, and a plurality of structure assemblies featuring a foundation including a positioning element and a ramp connectable with at least one said roadway segment.

BRIEF DESCRIPTION OF DRAWINGS

The invention will be better understood and other features and advantages will become apparent by reading the detailed description of the invention, taken together with the drawings, wherein.

DETAILED DESCRIPTION OF THE INVENTION

Figure 1:
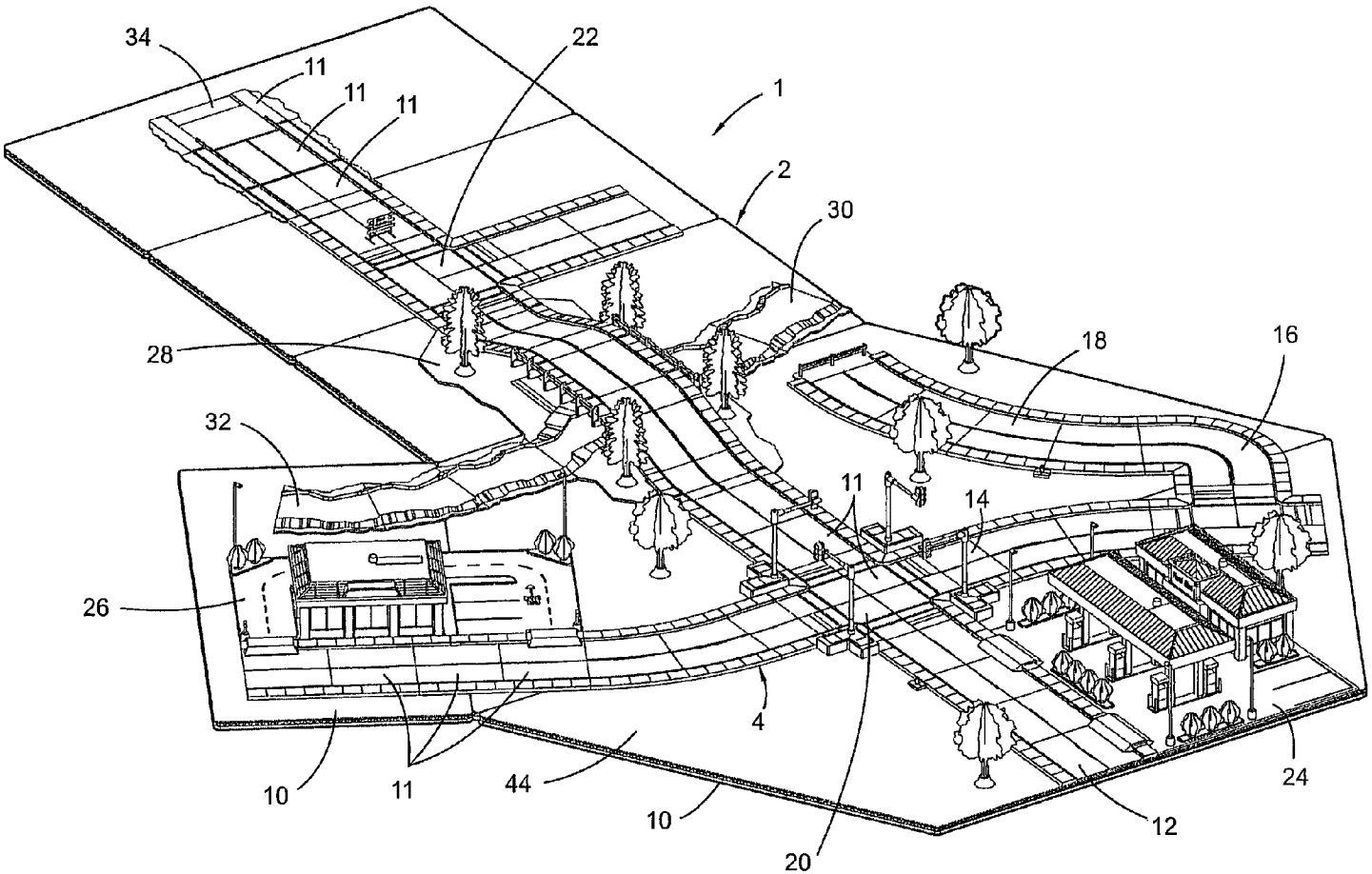
FIG. 1 is a perspective view of one embodiment of the play system showing an assembled playset having a base level with a plurality of base mat segments, a roadway level with a plurality of roadway segments and component accessories.

The playset system 1 according to the invention is illustrated in the numerous figures attached hereto. The playset system 1 comprises two main levels, namely a base level 2 and a roadway level 4, wherein the base level 2 is adapted to contact a surface of the ambient environment, namely a table top, floor, support framing such as saw horses or special constructed framing, furniture, for example a couch cushion, a chair, a bed, an outdoor surface such as grass, dirt, or concrete, or a combination of a flat and/or an angled surface, for example to create an angled surface, wherein a flexible coupler can be utilized to accommodate the angle between the flat surface and the inclined surface, or the like, and the roadway level 4 is disposed on the base level 2. As described herein, the roadway level 4 preferably includes a plurality of roadway segments or sections 11 that are interconnectable, i.e., abuttable, preferably substantially seamlessly on the base level 2.

The base level 2 in a preferred embodiment comprises two or more, and preferably a plurality of base play surfaces or base mats 10. Each base mat 10 has an upper surface, a lower surface and three or more side surfaces. The lower surface is adapted to contact the surface of the ambient environment. The roadway level 4 is adapted to be disposed on the upper surface of base mat 10. In the case of a base mat 10 having three side surfaces, the shape of the mat is triangular. When the base mat 10 has four sides, the overall configuration thereof can be square, rectangular, or any other geometric shape having four sides. When the base mat has five or more sides, the base mat 10 can have generally any geometric or non-geometric shape, and the arrangement of multiple base mats can have overall configurations limited only by the imagination. Examples of various shapes for base mats are disclosed in the Figures, see especially FIGS. 3A and 3B.

In one embodiment of the present invention, at least two base mats 10 are provided wherein at least one side surface of the first base mat and at least one side surface of the second base mat have a substantially equal length. Accordingly, when substantially same length side surfaces are abutted, a base level having a particular configuration is formed. When a base mat having side surfaces of a substantially same length are utilized, an array of configurations can be designed by the user.

Each base mat 10 of base level 2 preferably includes two or more layers as described herein. Preferably, the top layer includes the upper surface of the base mat with the upper layer comprising one or more magnets or a magnetically attractable material, or a combination thereof. The lower surface of the base mat is part of a lower layer that is adapted to contact the surface of the ambient environment.

Each roadway segment 11 has an upper surface, a lower surface and at least three side surfaces. In a preferred embodiment, each roadway segment has at least four side surfaces. The lower surface of the roadway segment 11 contacts the upper surface of a base mat 10 and base level 2. The upper surface of the roadway segment 11 in one embodiment includes a depiction of a road surface, and a curb located on each side of the road surface. Preferably, two or more roadway segments, including road surfaces and curbs are utilized in various embodiments of the invention, whereby the road surfaces and curbs of adjacent roadway segments can be abutted to form a longer, combined roadway segment.

The lower surface of the roadway segment 11 includes a magnetic material or a magnetically attractable material, or combinations thereof in order to magnetically connect a roadway segment 11 to a base mat 10 in a preferred embodiment of the present invention. Each base mat and roadway segment can contain one or more of the magnets or magnetically attractable material, so long as the roadway segment and base level are magnetically connected to each other. The roadway segments optionally include structure assemblies, new construction assemblies or terrain assemblies as described herein.

In particular, FIG. 1 illustrates one embodiment of a realistic play system 1, preferably scaled to 1:64 size specifically to accommodate toy die cast vehicles, is shown in one of many possible assembled arrangements. As shown, the play system includes play surface base mats 10. The play system 1 also includes roadway sections 11 that have the ability to be arranged in a multitude of configurations. These roadway sections 11 include, but are not limited to, a straight segment 12, a partial straight segment 14, a right angle segment 16, a curved segment 18, a four-way intersection segment 20, and a three-way intersection 22. Further inclusive to the play set are one or more structure assemblies. As shown, a first example of a structure assembly is realistically detailed to be a facsimile of a contemporary gas station and convenience store 24. Also shown, a second example of a structure assembly is realistically detailed to model a drive through restaurant 26. Other structure assemblies to be included in the play set can be any and all types as encountered in every day life to include, but not limited to, residences, townhouses, stores, malls, low and high rise office buildings. Preferred types to the current invention will be those that promote imaginative play and interaction with toy die cast vehicles. A roadway infrastructure and natural terrain assembly 28 is also shown. Illustrated is an example bridge assembly traversing a running stream. The natural terrain components include arrangeable stream segments similar to the aforementioned road segments, in particular a straight stream segment 30 and curved stream segment 32. Other roadway infrastructure assemblies that promote play with toy die cast vehicles can include roadway overpasses, tunnels and construction zones 33, for example.

Figure 2:
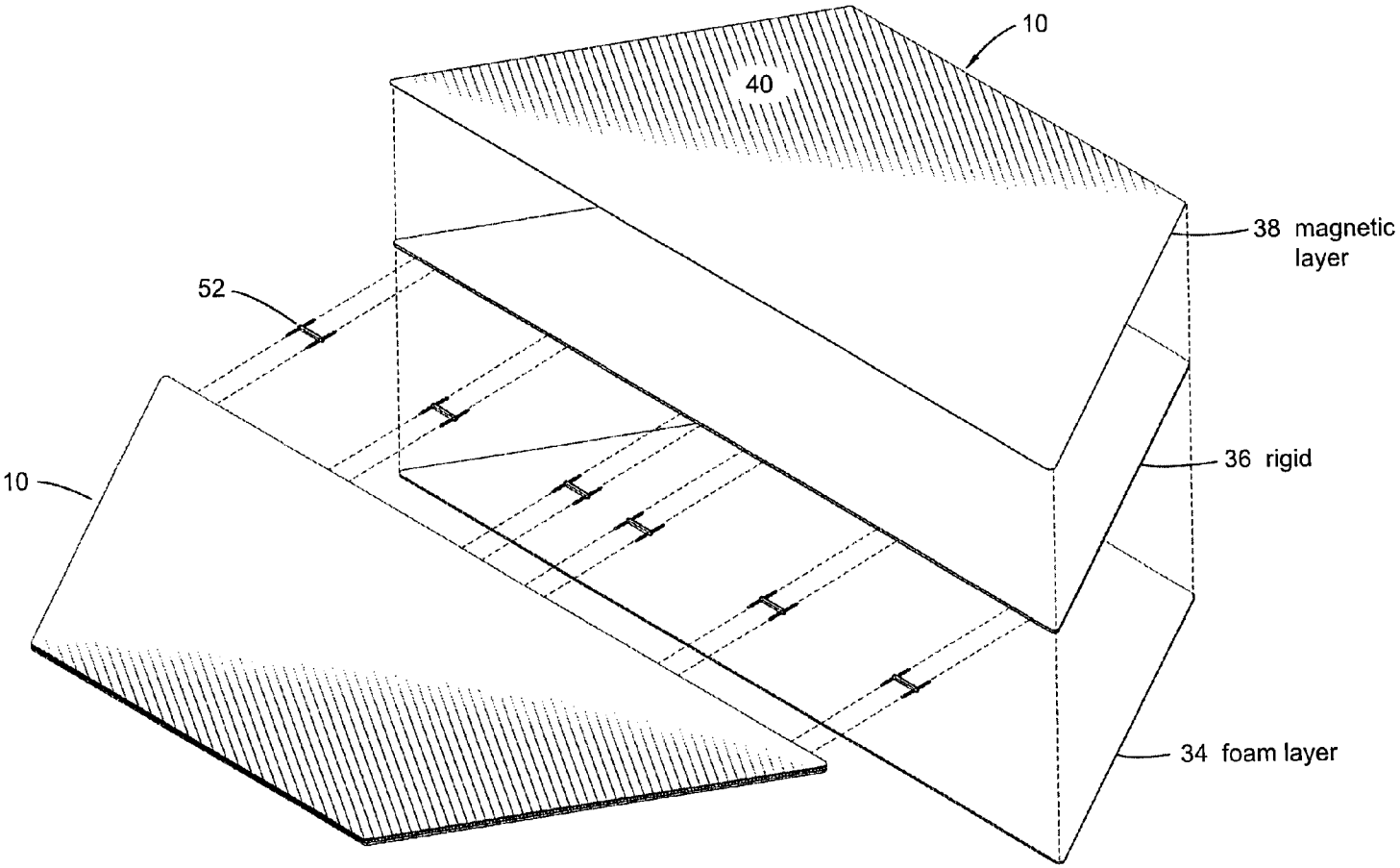
FIG. 2 is an exploded perspective view of one embodiment of the play mat surface showing a layered construction that features a magnetic layer.

As described hereinabove, the base level 2 has at least one base mat 10 including a plurality of layers, i.e., at least two layers. The base mat layers include at least one magnetic or magnetically attractable layer and at least one other layer. As seen in FIG. 2, a magnetic base mat 10 is shown in exploded view in one preferred form of construction and materials. The embodiment illustrated is a three layer base mat 10. A bottom layer 34 is adhered to a middle layer 36, preferably rigid, which is adhered to a top layer 38. The bottom layer 34 is preferably a foam layer made from a thin closed cell polyethylene foam sheet and serves to prevent the play surface from easily sliding and to protect the surface it sets upon. The bottom layer 34 can also be made from other closed and open cell foam and non-foam (no air cells) materials. The bottom layer 34 generally comprises a polymer, for example such as polyurethane, a vinyl, such as polyvinylchloride, a polymer, for example neoprene, EPDM (ethylene-propylene-diene monomer), Santoprene rubber, silicone rubber, Buna-N rubber and natural gum rubber, or a combination thereof. The middle layer 36 is preferably rigid and fabricated from a polyethylene plastic corrugated board and serves to provide the play surface base mat 10 with a rigid construction characteristic. The base mat 10 can also be made not to include middle layer 36 so that it may be flexible and have the ability to be rolled up for storage when the play system 1 is not in use. The middle layer 36 can also be manufactured from other sheet materials, either polymer or non-polymeric, for example cellulose derived, including, but not limited to, corrugated card board, rigid foam, foam core, polystyrene, polyethylene, polycarbonate, acrylic and urethane.

As indicated hereinabove, top layer 38 is preferably magnetic and includes one or more magnetic materials or magnetically attractable materials. In one embodiment, top layer 38 comprises flexible magnetic sheeting. In one embodiment, the flexible magnetic sheeting comprises a surface vinyl layer 40 connected to a magnetic layer comprising a magnetic powder such as ferrite magnetic powder and a polymer. The magnetic powder and polymer are preferably mixed, melted and calendered or extruded, then magnetized. In one embodiment, the standard energy for a magnetic layer is isotropic and, therefore, invariant with respect to direction or identical in all directions. The magnetic layer can be magnetized in multiple poles concentrating magnetic power on one face to provide maximum magnetic field strength. The side of the top layer 38 opposite vinyl layer 40 is preferably adhered to another layer of the base mat 10 utilizing an adhesive, preferably a pressure-sensitive adhesive in one embodiment. The upper, exposed surface of the vinyl layer 40 is printed in one embodiment with one or more images, preferably high resolution images and patterns of natural or man made terrains including grass, vegetation, dirt, rocks, gravel or concrete, for example. The top layer 38 is adhered to the middle layer 36, preferably with the magnetic side and printed vinyl layer 40 facing upward. This construction technique enables magnetic attraction of the top, upper face of the play surface base mat 10 through the printed vinyl layer 40. The magnetization of the top layer 38 serves to provide the play system 1 with a means in which an array of accessories can be securely, but not permanently, placed into position. As the preferred embodiment comprises the aforementioned layers, one skilled in the art can readily utilize other alternative configurations of the play surface base mat 10 that would provide a secure, yet movable placement of accessories through magnetization as well. One such configuration, for example, would replace the aforementioned top layer 38 with a thin metal sheet that can be magnetized, for example a steel sheet. The steel sheet can then be covered with the vinyl printed layer 40 and accessory pieces or roadway sections 11 featuring magnets within their bases for accomplishing magnetic positioning.

Figure 3A:
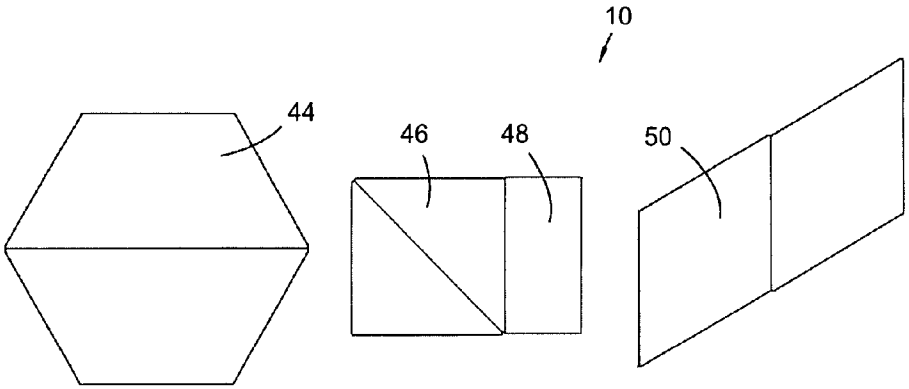
FIGS. 3A and 3B are top views of embodiment of different play base level mat surface shapes, wherein the common edge length these shapes share illustrate a few of many potential arrangements, respectively.
Figure 3B:
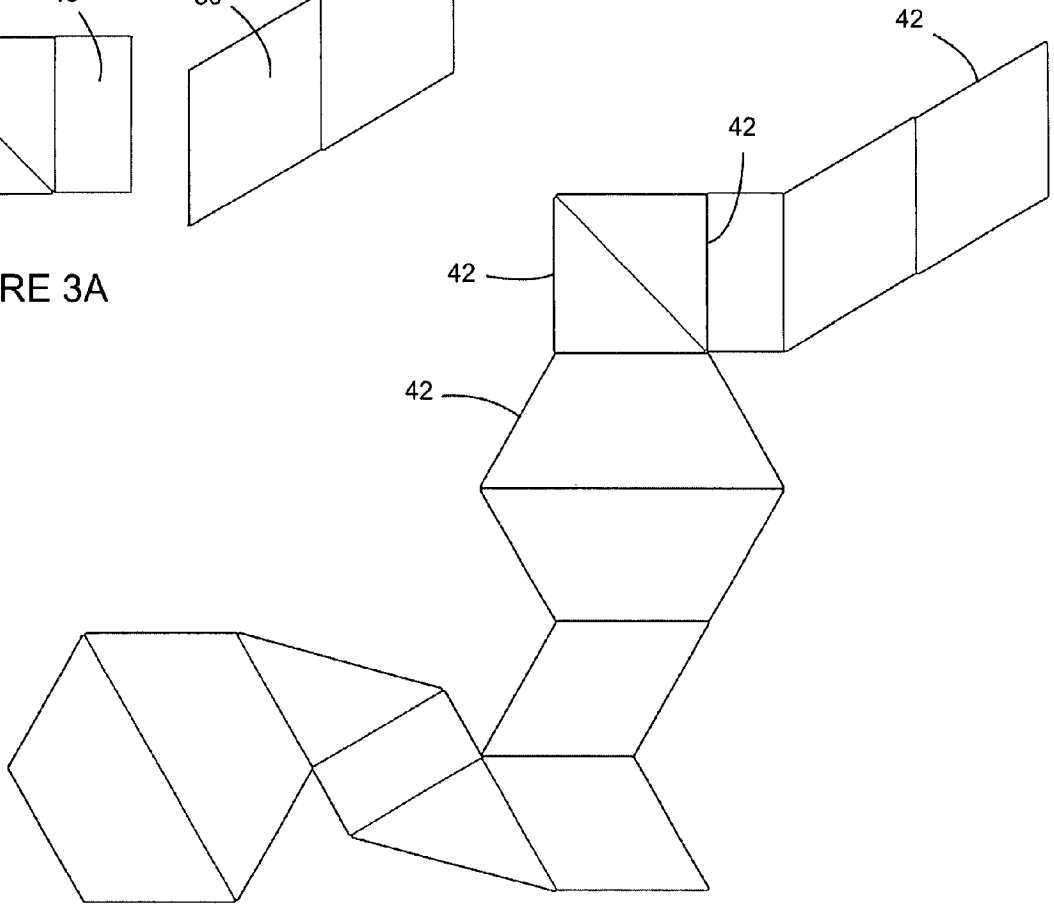

Referring further to FIG. 3A and FIG. 3B, the playing surface base mats 10 are shown in several possible shaped segments featuring a common edge length 42. The common edge length 42 provides a means in which additional, differently shaped play surface base mats 10 can be arranged in a multitude of ways. The shapes featuring the common edge length 42 include, but are not limited to, a hexagonal half 44 (as presented in FIG. 2), a triangle 46, a rectangle 48 and a parallelogram 50. The common edge length 42 of said differently shaped play surface base mats 10 feature prefabricated apertures or holes 42 in which couplers 52 are inserted as described below in order to connect adjacent base mats 10. Standardized spacing of the apertures 60 in all common edge lengths 42 enables the play system 1 to expand in possible arrangements as acquisition of the differently shaped play surface base mats 10 increases.

Figure 4:
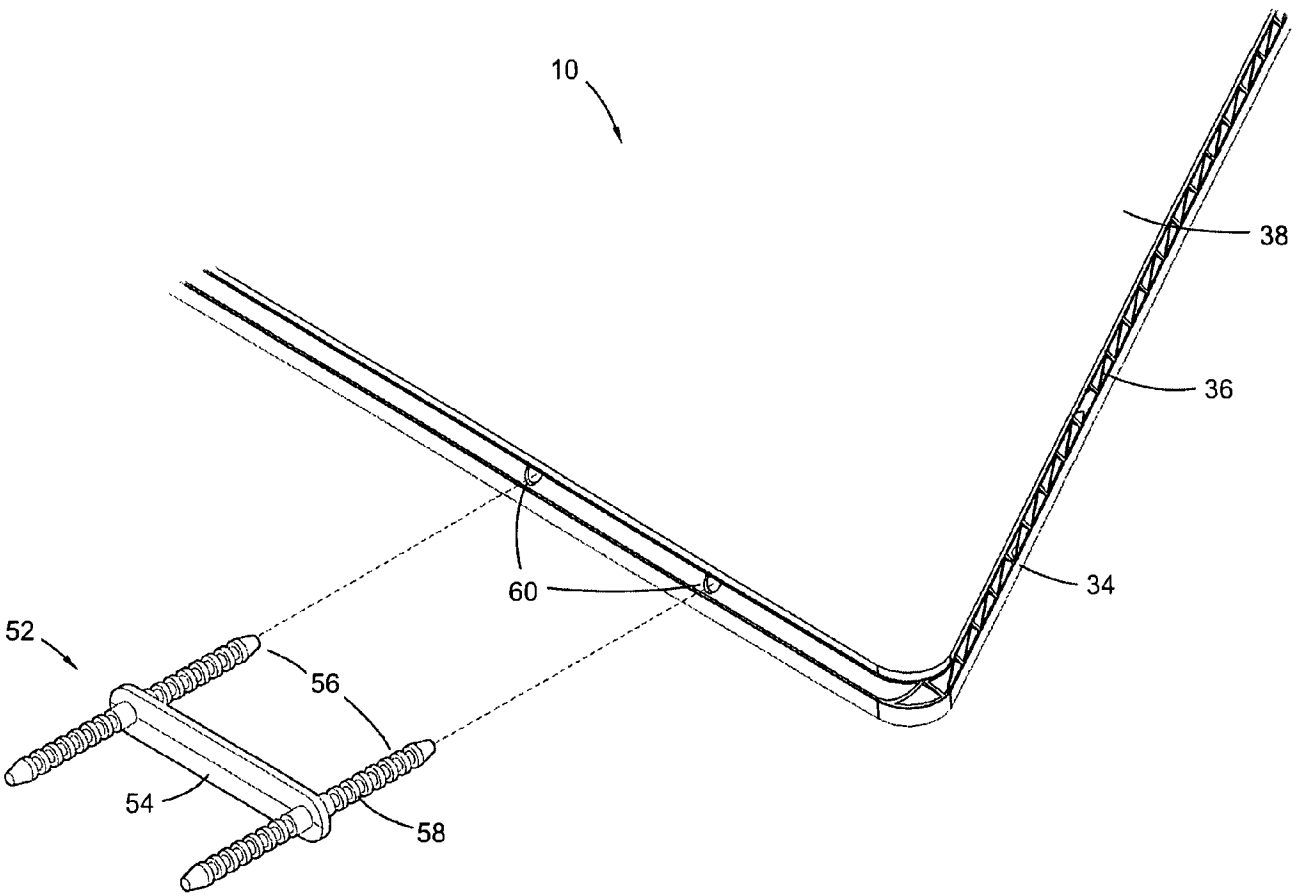
FIG. 4 is a partial perspective view of a coupler for joining play mat surfaces together.
Figure 5A:
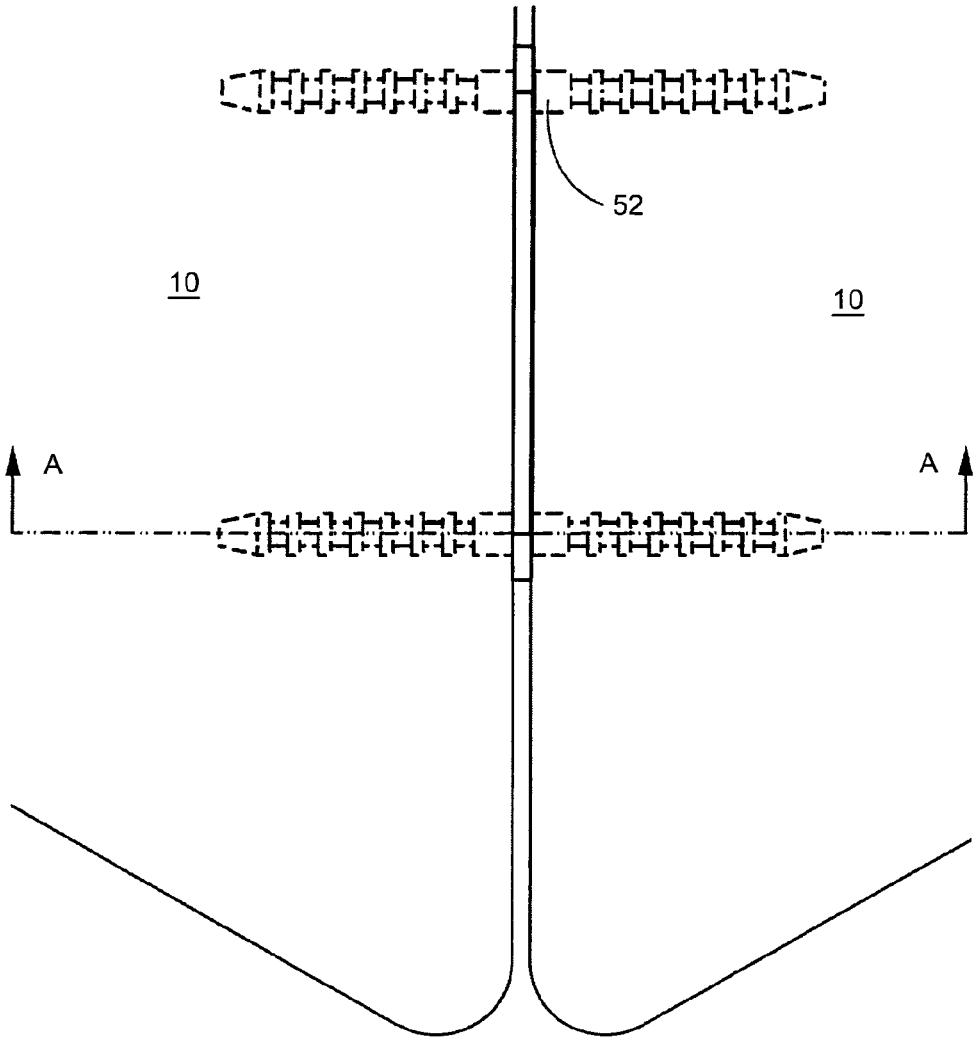
FIG. 5A is a top view of a coupler illustrated in FIG. 4 for joining two base mat surfaces together, wherein the base level base mat surfaces are partially shown.
Figure 5B:
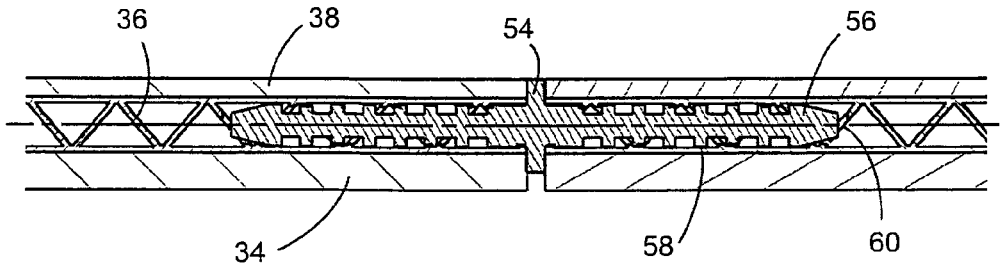
FIG. 5B is a partial cross sectional view of the coupler in FIG. 4 with assembled play base mat surfaces through line section AA illustrated in FIG. 5A.

Referring to FIG. 4, FIG. 5A and FIG. 5B, the layered construction of the play surface base mat 10 in one embodiment is provided in segments assembled together with play surface couplers 52. The couplers 52 are preferably molded from a rigid plastic and feature a middle pad 54 in one embodiment. Posts 56 located symmetrically to either side of the pad 54, feature concentric integral ribs 58. Pre-fabricated apertures 60 in the middle layer 36 are spaced such to receive the posts 56 on center. The posts 56 and concentric ribs 58 are sized such to provide a press fit in to pre-fabricated apertures 60 in a common edge length 42 of the middle layer 36. The outer edges of the concentric ribs 58 serve to catch and provide further resistance on the surfaces they come into contact with, thus making the coupler 52 resistant to easily pulling out of the apertures 60. In a preferred embodiment, the couplers 52 are made from rigid nylon to resist breakage. The couplers 52 can also be made from a host of other materials, preferably a polymer, including, but not limited to, polycarbonate, polystyrene, acrylic, polyethylene or polypropylene.

Figure 6:
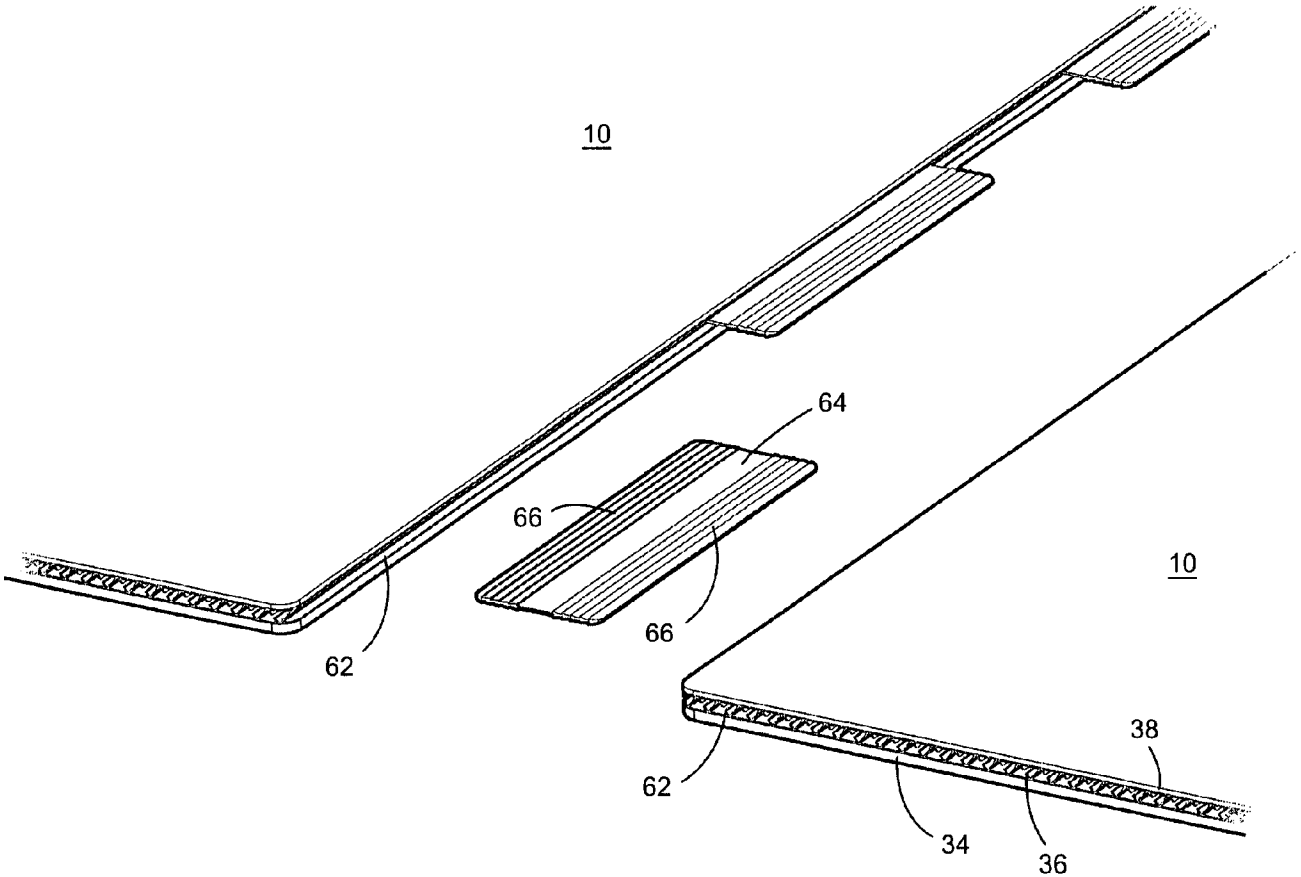
FIG. 6 is a partial perspective view of an alternative coupler design for joining play base mat surfaces together.
Figure 7A:
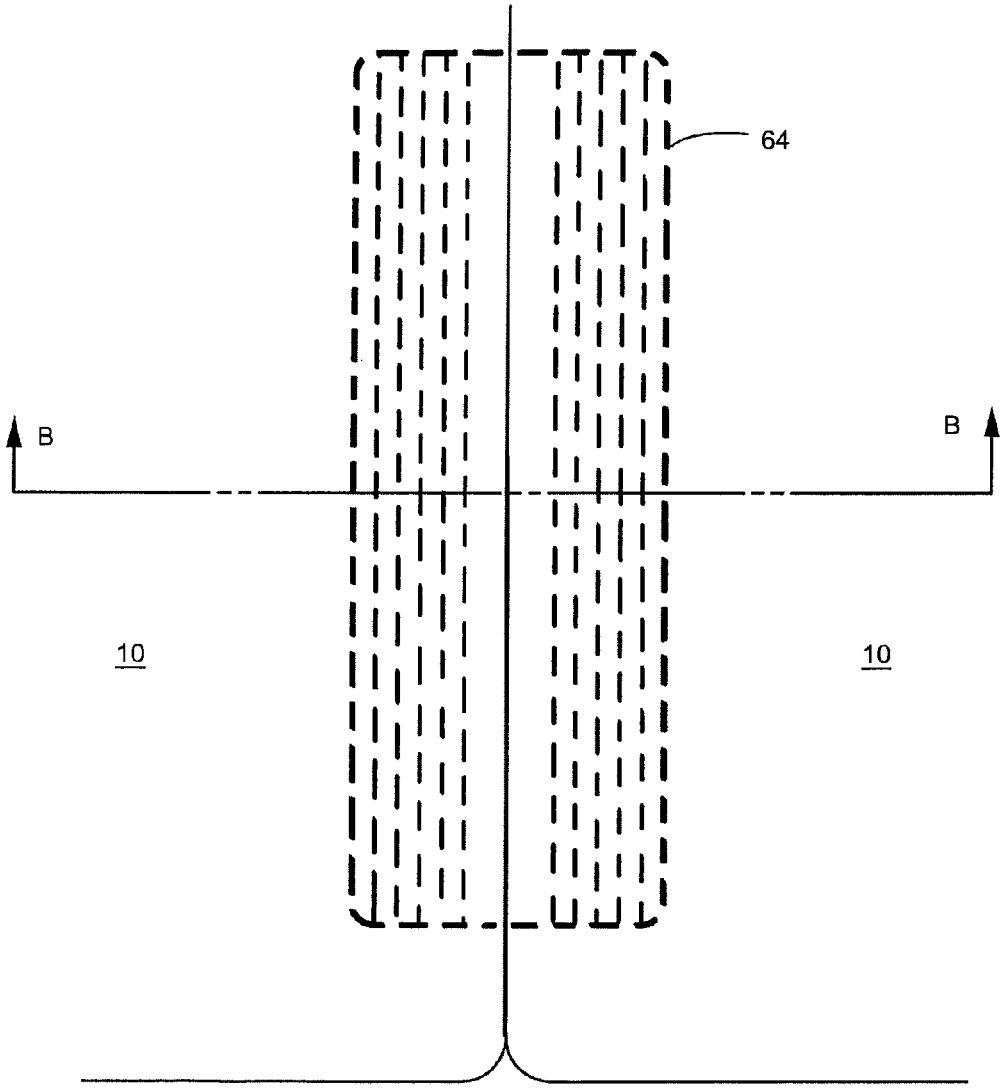
FIG. 7A is a top view of an alternative coupler illustrated in FIG. 6 for joining play base mat surfaces together, wherein the base level base mat surfaces are partially shown.
Figure 7B:
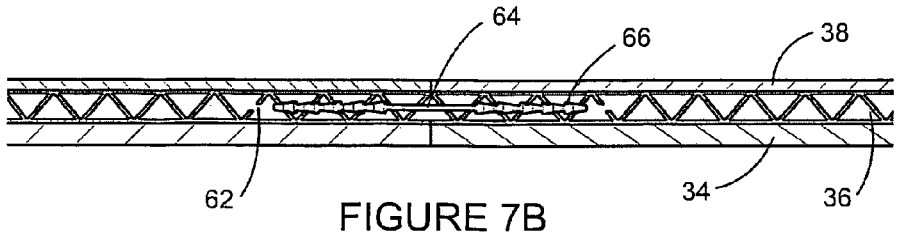
FIG. 7B is a partial cross-sectional view of the alternative coupler design in FIG. 6 with assembled play base mat surfaces through line section BB illustrated in FIG. 7A.

FIG. 6, FIG. 7A and FIG. 7B show an alternate embodiment method for joining the differently shaped play surface base mats 10 together. As illustrated, a tongue and groove detail is used where the groove 62 is cut in to the middle rigid layer 28, and a two-sided tab component 64 of appropriate width and length used to press fit into and maintain a closed seam between the shaped play surfaces 10 when the edges are pushed together. The two-sided tab component 64 features barbed edges 66 running the length of the top and bottom face that serve to catch and provide further resistance on the surfaces they come into contact with to resist easily pulling out of the groove 62.

Figure 8A:
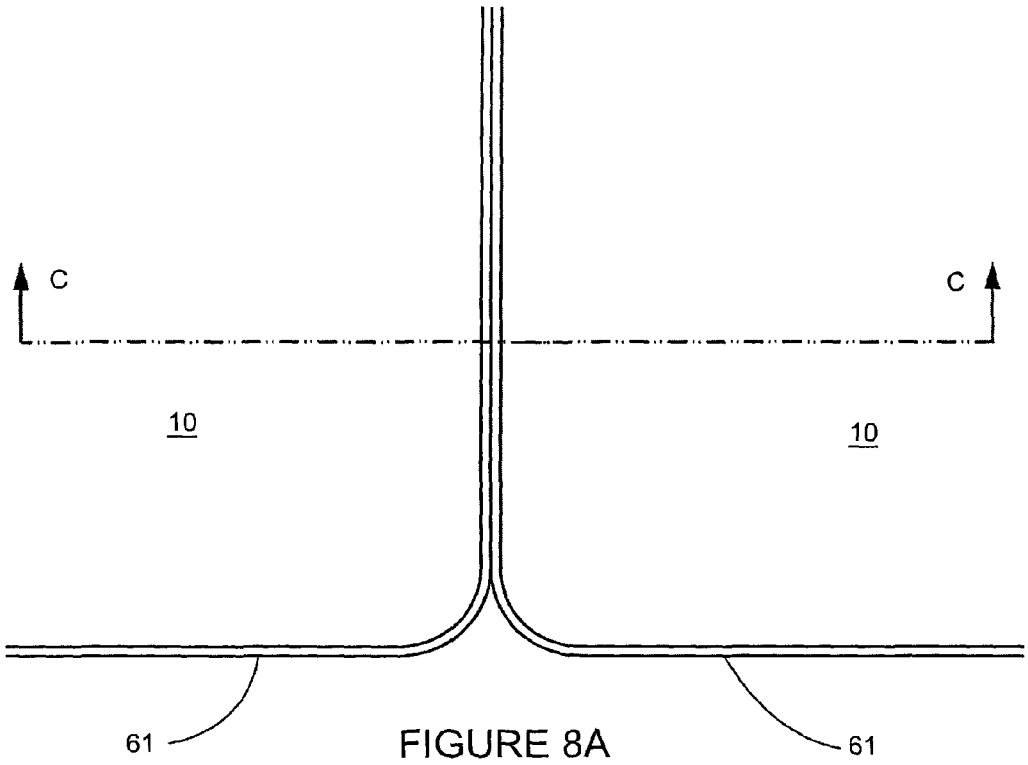
FIG. 8A is a top view of an alternative method for joining play base mat surfaces together, wherein the base level base mat surfaces are partially shown.
Figure 8B:
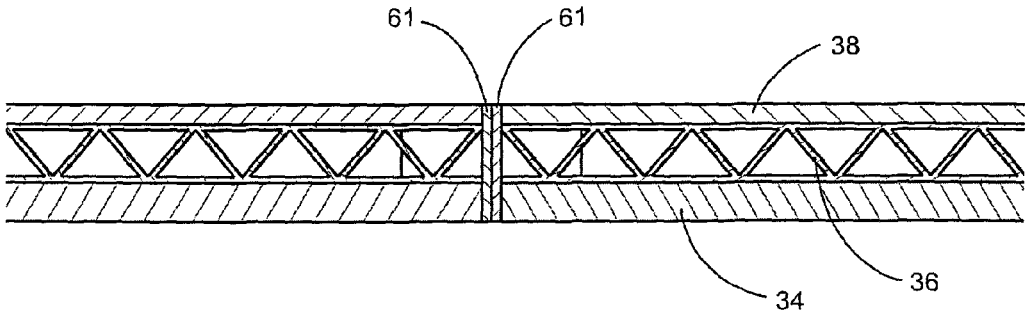
FIG. 8B is a partial cross-sectional view of an alternative method for joining the play base mat surfaces together through line section CC illustrated in FIG. 8A.
Figure 8C:
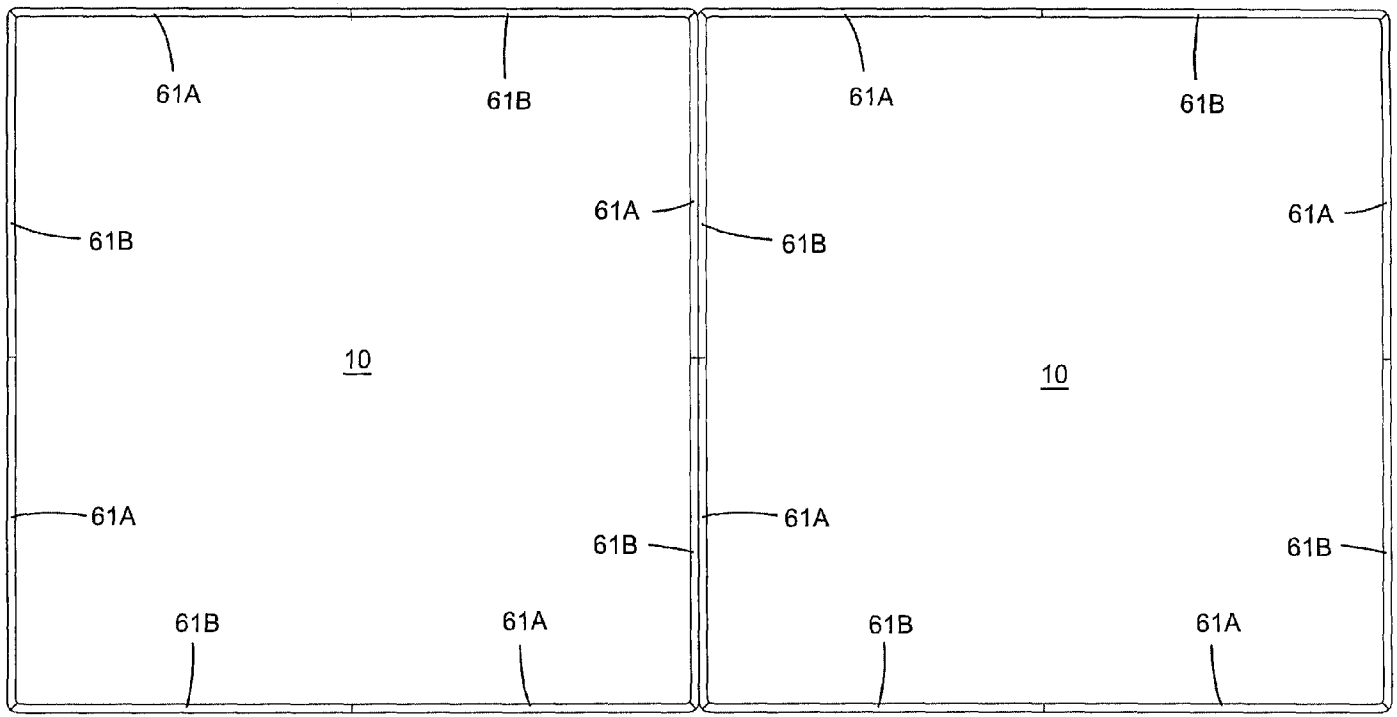
FIG. 8C is a top view of an alternative embodiment for joining play base mat surfaces together, wherein each side surface of the mat includes both a magnetic element as well as a magnetically attractable element.
Figure 8D:
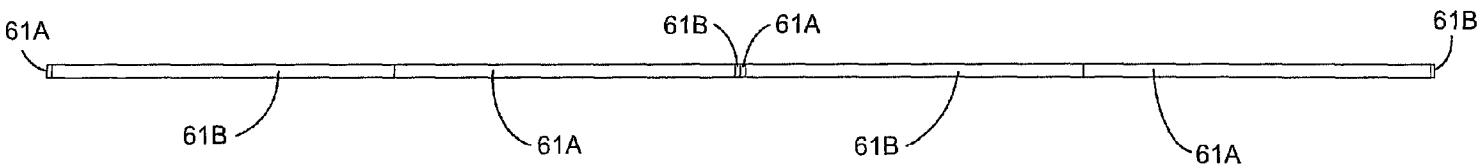
FIG. 8D is a side elevational view of the embodiment illustrated in FIG. 8C.

FIGS. 8A and 8B show yet another alternate embodiment method for joining the differently shaped play surface base mats 10 together. In one embodiment, a side surface of a base mat 10 is provided with one or more of a magnetic material or magnetically attractable material and a side surface of the second base mat is provided with the complimentary material such that the side surfaces of the base mat are interconnected via magnetism or a magnetic field. In the embodiment illustrated in FIG. 8A, a magnetic material, namely a magnetic strip 61 is adhered in a longitudinal direction onto the play surface base mat 10 side surface perimeter and a magnetic strip 61A is adhered in a longitudinal direction to the left side play surface base 10 side surface perimeter. As with the top layer 38, the magnetic face of the flexible magnetic strip 61 faces outward to allow for magnetic attraction to the magnetic strip 61 of play surface base mat 10 edge. In one embodiment, see FIGS. 8C and 8D for example, a single side surface includes at least one section including a magnetic material 61A and at least one section including a magnetically attractable material 61B. When two base mats 10 of this construction are provided, the magnetic material 61A for one side surface of the base mat is interconnected with the side surface of the other base mat, including the magnetically attractable material 61B.

Figure 9:
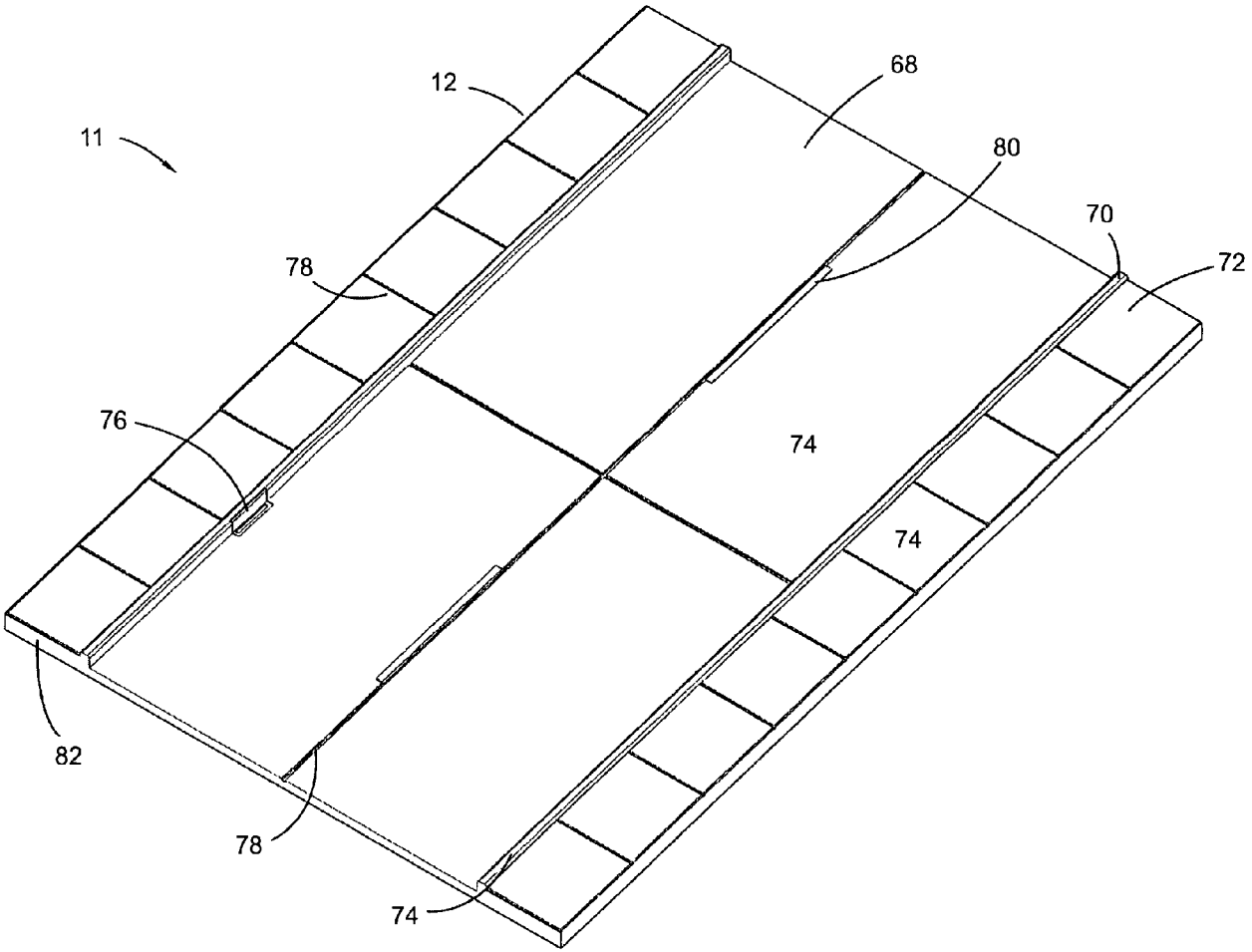
FIG. 9 is a top perspective view of a straight road section.

One embodiment of a roadway segment 11 is illustrated in FIG. 9. In particular, the roadway segment 11 is a straight road segment 12 that features a relief surface and realistic 1:64 scale details and textures. A roadway surface 68 sets between raised curbs 70 and raised sidewalks 72, preferably all of which feature a textured surface 74 to resemble that of asphalt and formed concrete. As illustrated in at least FIG. 9, the curb 70 height measured between the lower surface and the upper surface of the roadway segment 11 is greater than the height of the roadway 68 measured between the upper surface and lower surface of the roadway segment 11 in one embodiment. Preferably, the sidewalk 72 has a height greater than the height of the roadway 68, and less than or equal to the height of the curb 70. As illustrated in FIG. 1, in one embodiment the two adjacent roadway segments 11 abut each other such that the curb 70 of one roadway segment 11 contacts the curb 70 of a second roadway segment 11, and likewise, the roadway 68 of the first roadway segment 11 contacts the roadway 68 of the second roadway segment 11 in order to provide continuity between adjacent roadway segments. Inset sewer drains 76 and pavement cracks 78 are further included in the surface detail to promote a sense of realism. Roadway markings 80 are included and formatted to match full size standards in preferred embodiments. All said details are preferably standard to all the aforementioned road segments such as shown in FIG. 1, including the partial straight 14, the right angle 16, the curve 18, four-way intersection 20 and three-way intersection 22. Roadway segments 11 are preferably formed from a polymeric material, wherein the road segments are injection molded in one embodiment. In one preferred embodiment of the play system 1, road segments 11 are molded from a flexible elastomer material. This material serves to make the road segments durable, non-breakable and easy to clean. Additionally, the textured surface 74 of the roadway 68, curbs 70, sidewalks 72 and road markings 80 are painted or printed with the appropriate colors of the represented surfaces to further add a sense of realism to the play system 1. Colors can alternatively be achieved through a co-molding process of colored plastic as well. Road segments 11, as described, can be fabricated from a multitude of elastomer materials or other closed and open cell foam materials to include, but not limited to, polyurethane, a vinyl such as polyvinyl chloride, neoprene, EPDM (ethylene-propylene-diene monomer), rubber, such as Santoprene rubber, silicone rubber, Buna-N rubber and natural rubber. Polymers including, but not limited to, polystyrene, polyurethane, polycarbonate, polyethylene or polypropylene may be used as well.

Figure 10:
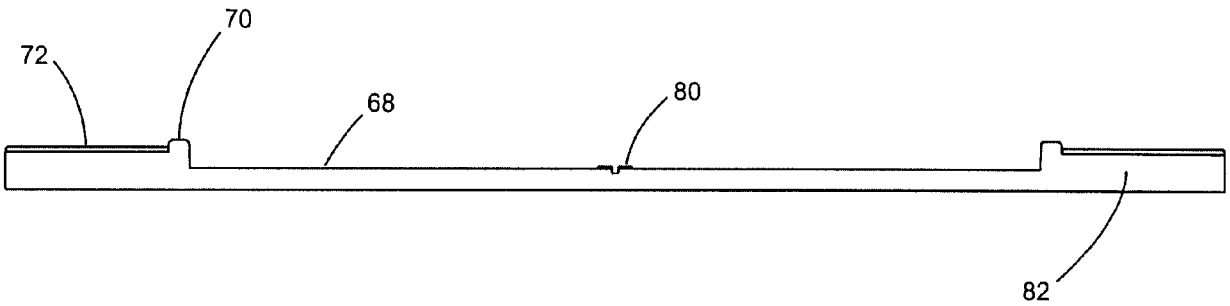
FIG. 10 is a side edge profile plan view of one embodiment of a road section configuration showing the degree of surface relief and detail.

As shown in FIG. 10, an end profile 82 of a road segment 11 is illustrated. Consistency of this or a like profile from one road segment to the next enables a multitude of configurations with even transition. In the preferred embodiment, other types of roads with different end profiles are fashioned for use with the play system 1. Examples of additional road segments include, but are not limited to, a roadway under construction, a residential street, an entrance and access drive, a gravel road and a dirt road, for example.

Figure 11:
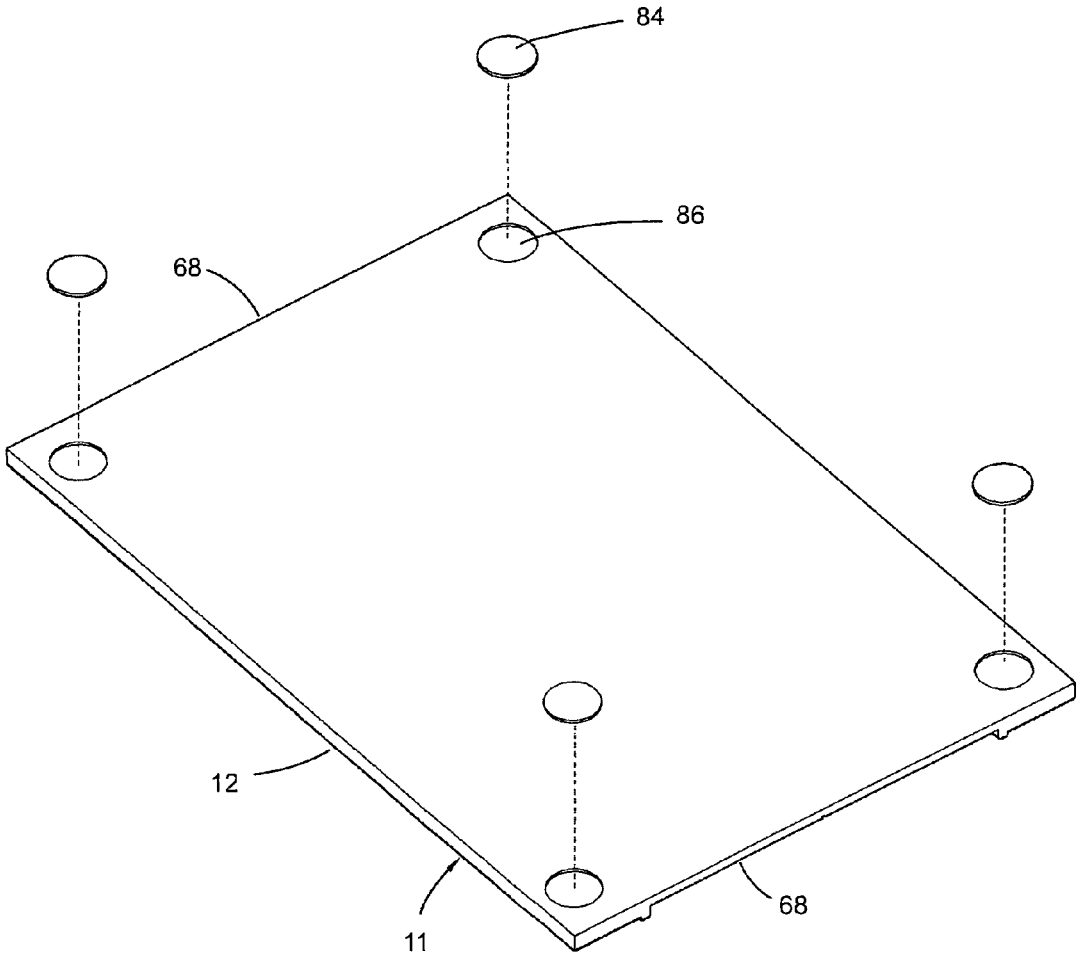
FIG. 11 is a bottom perspective view of a straight road section showing where thin positioning elements that attract to the magnetic base level surface are to be affixed.
Figure 12:
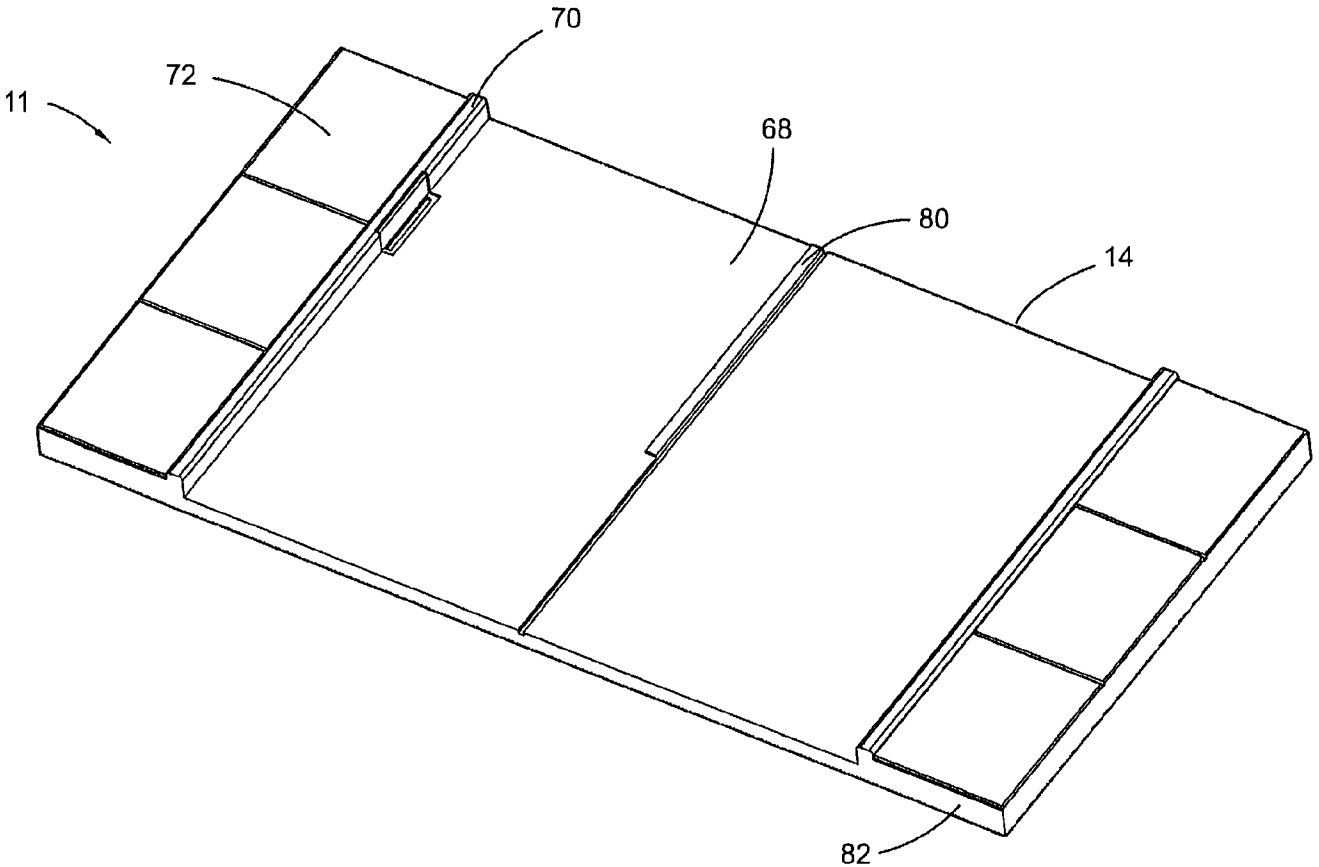
FIG. 12 is a top perspective view of a partial straight road section.
Figure 13:
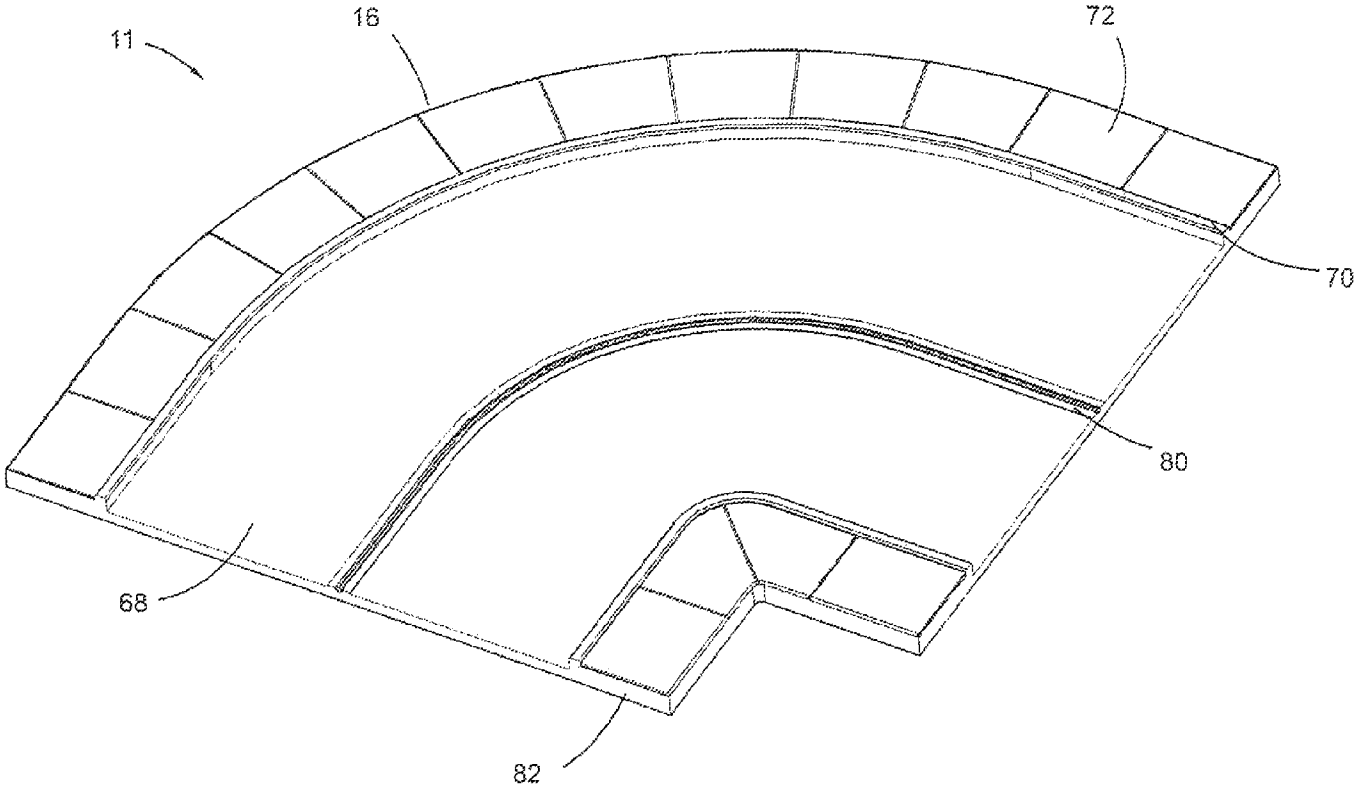
FIG. 13 is a top perspective view of a right angle road section.
Figure 14:
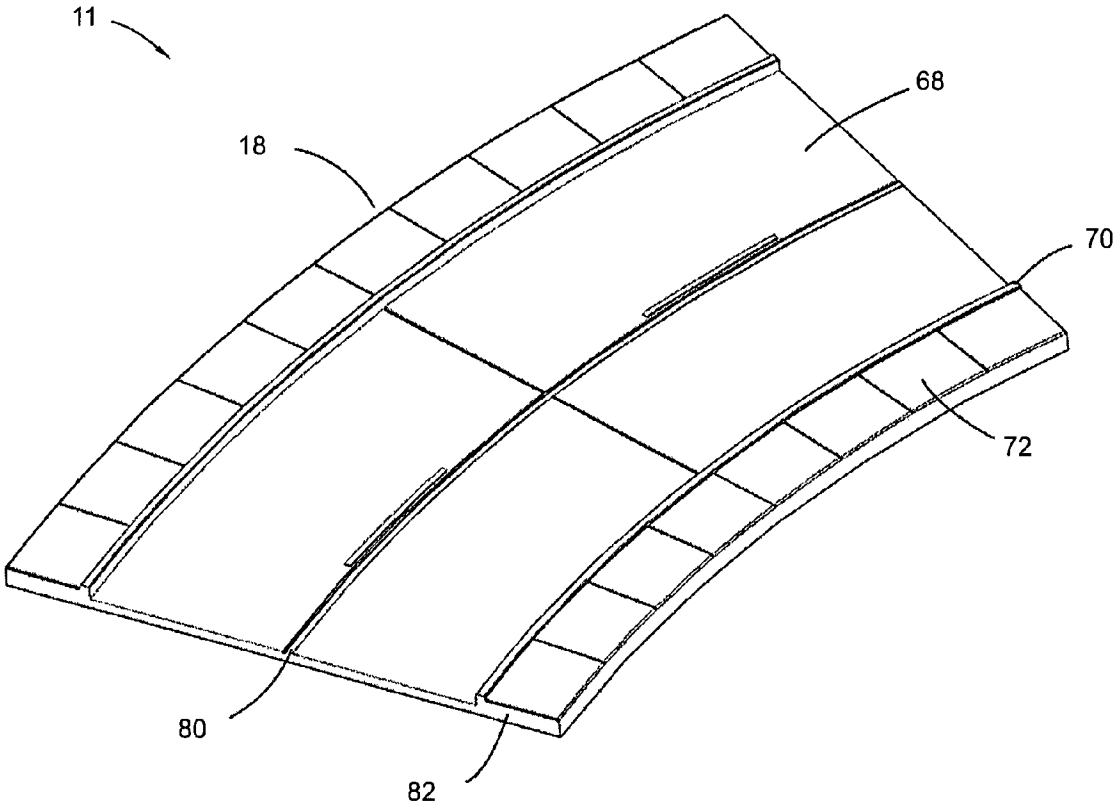
FIG. 14 is a top perspective view of a curved road section.
Figure 15:
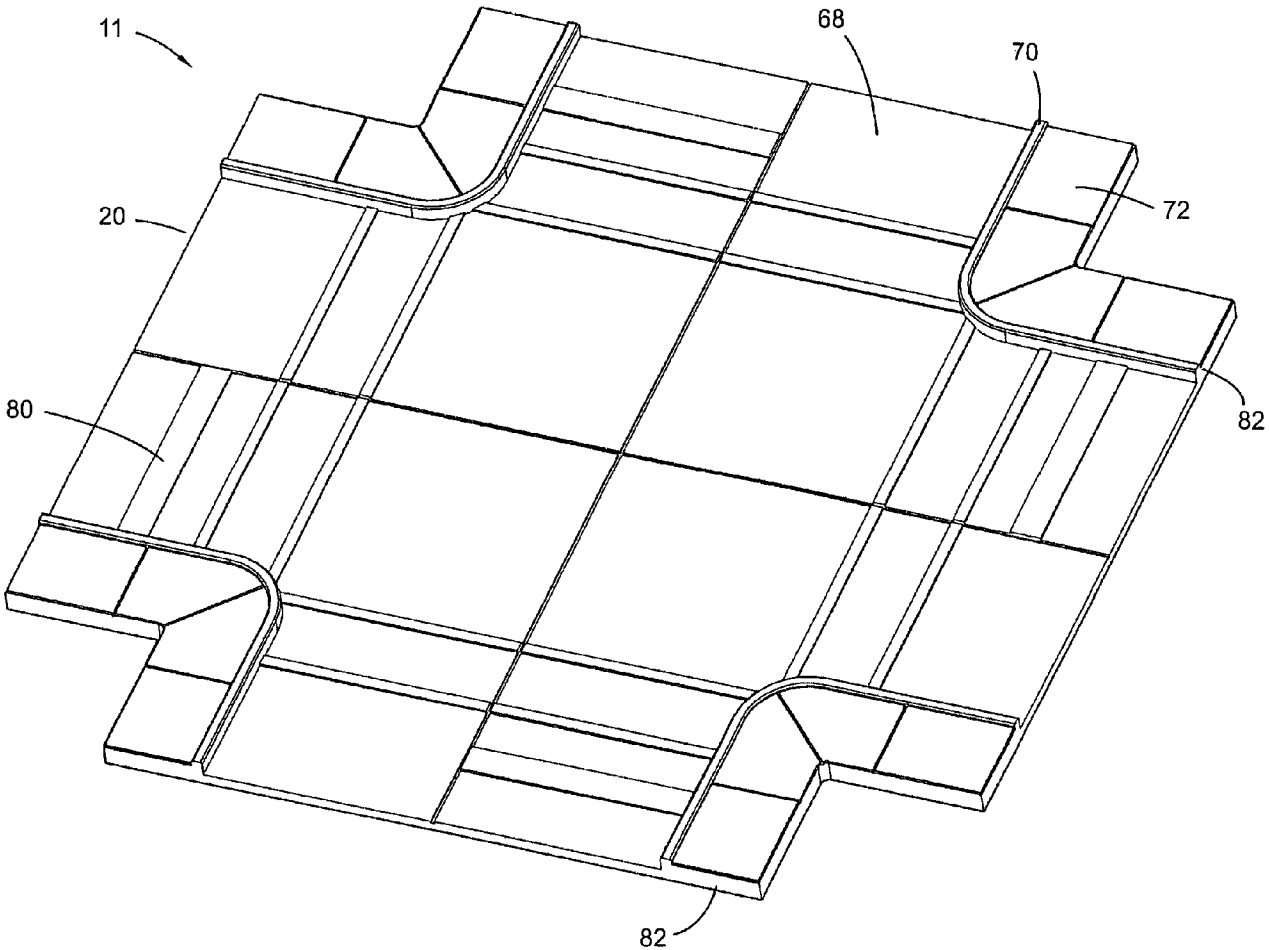
FIG. 15 is a top perspective view of a four-way road intersection.
Figure 16:
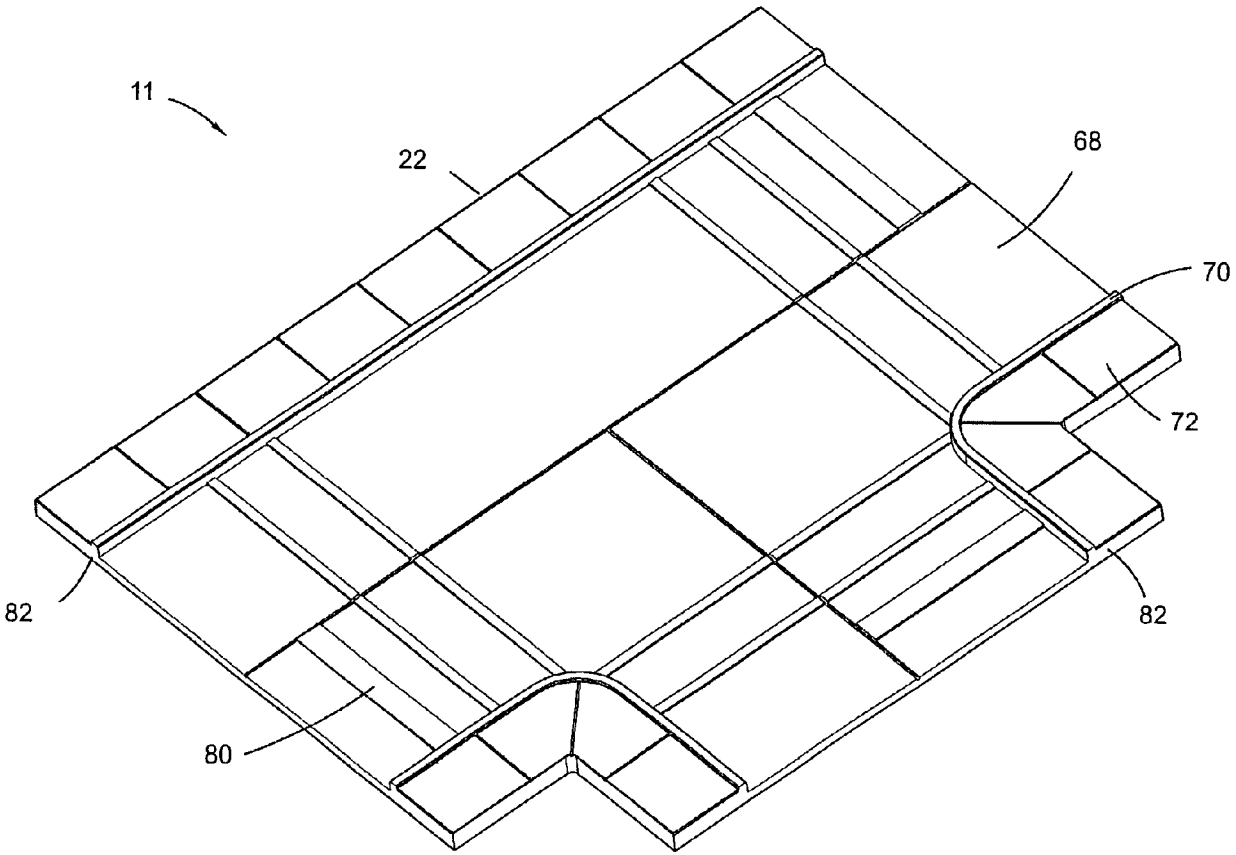
FIG. 16 is a top perspective view of a three-way road intersection.

As described herein, the lower surface of roadway segment 11 is provided with a magnetic material or a magnetically attractable material in one embodiment such that the roadway segment 11 is magnetically connectable to base mat 10 of playset system 1. In one embodiment, a recess 86 is present in the lower surface of roadway segment 11 and the positioning element is placed within the recess 86, wherein the positioning element comprises magnetic material or magnetically attractable material. Referring to FIG. 11, one embodiment of a lower surface of a roadway segment is shown containing positioning elements in the form of discs 84 that are affixed to, for example utilizing an adhesive or fastener in some embodiments, or integrally molded into recesses 86. The recesses 86 are preferably located in close proximity to the end profile 82 on each side of road segment 11. This location serves to maintain the butt joint between segments as they are arranged on the play surface base mat or mats 10. In the preferred embodiment, the positioning elements 84 are made from, for example, thin steel, a flexible magnetic sheet or a magnet. The positioning elements 84 are formatted in size and position to provide optimum securing to the play surface base mat 10.

FIG. 12 through FIG. 16 show a partial road segment 14, a right angle road segment 16, a curved road segment 18, a four-way intersection 20 and a three-way intersection 22, respectively. The end profile 82, preferably consistent to road segment 11 is shown in each.

Figure 17:
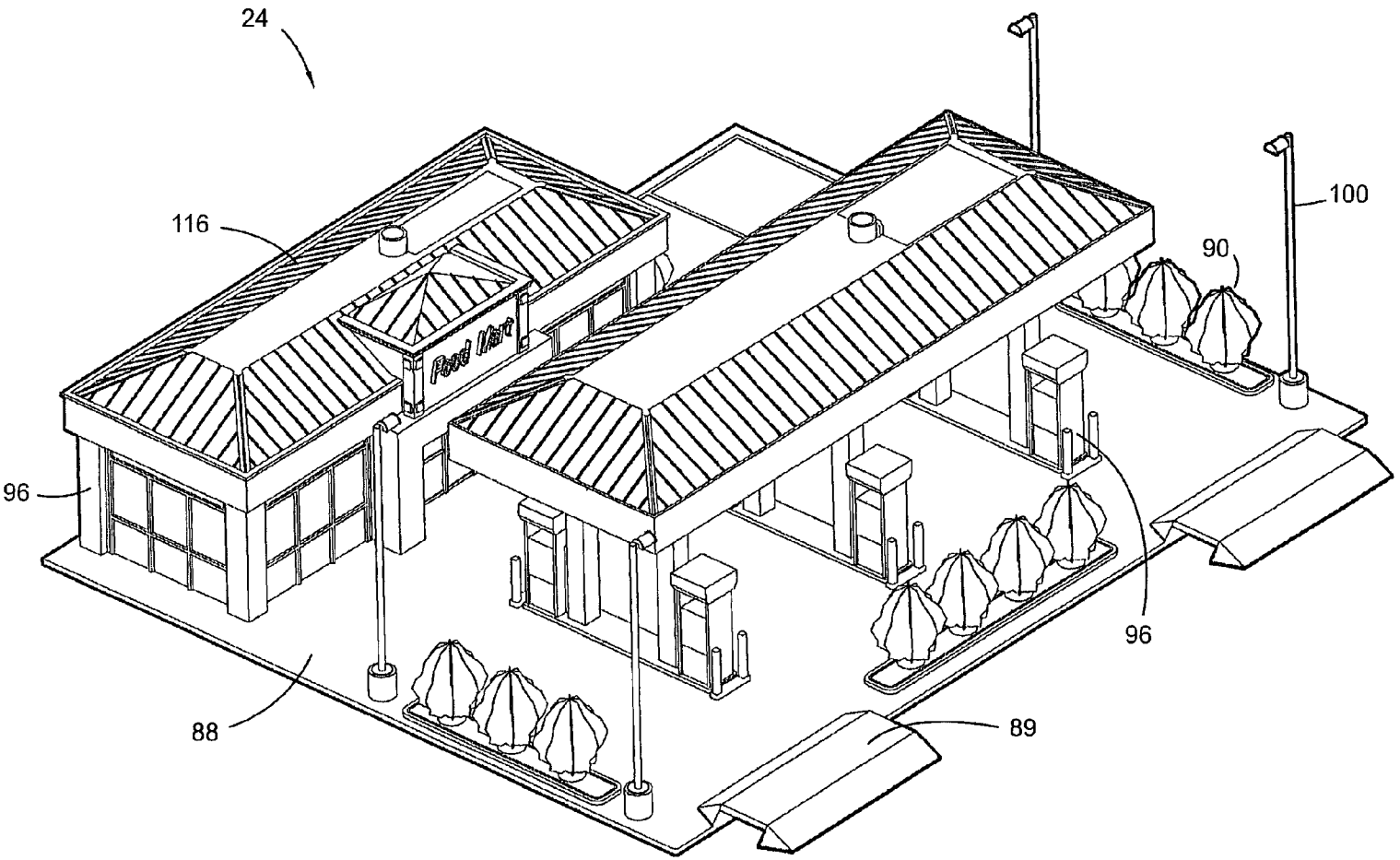
FIG. 17 is a top perspective view of an assembled first building accessory in FIG. 1.
Figure 18:
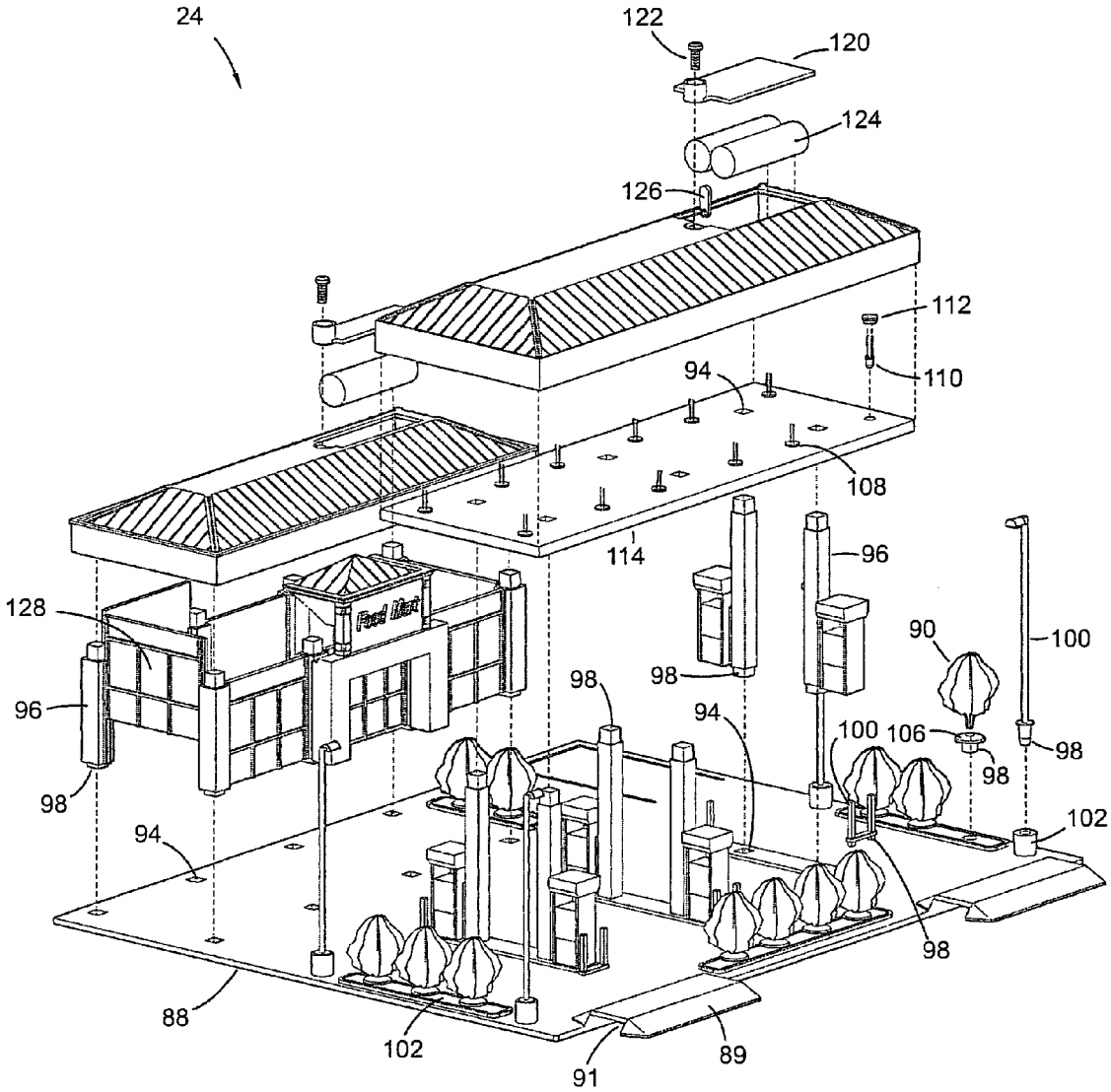
FIG. 18 is an exploded perspective view of the first building accessory in FIG. 1 showing the preferred construction and features.

Referring to FIG. 17 and FIG. 18, a first example of a standard structure assembly 24 is shown in perspective and in exploded view form, respectively, to present a preferred form of construction and materials used. In this example, a gas station and convenience mart are depicted. The assembly shows a foundation 88 that serves as the structure platform in which other components of the structure assembly 24 are to be assembled onto. Similar to road segment 11 described above, the foundation 88 is to be preferably molded from a polymeric elastomer. Surface details integrally molded to the top surface of the foundation 88 are preferably scaled to 1:64 representations of corresponding full size features. As with the road segments above, textured surfaces can be painted or printed with the appropriate colors of the represented surfaces to further add a sense of realism to play system 1. These colors can alternatively be achieved through a co-molding process of colored plastic as well. Integrally molded ramps 89 in the foundation 88 are preferably provided in structure accessories where toy die cast vehicle interaction is involved. The ramps 89 can also be curved with radii that match that of the right angle road segment 16 or curved segment 18. The ramps 89 feature a bottom notch 91 that serves to fit and secure the foundation 88 over the raised curb 70 and sidewalk detail 72 on a road segment 11. As with road segment 11 above, positioning elements 84 are located strategically on the bottom side of the foundation 88 within recess 86 close to the periphery and additionally secure it from moving. Further integral to the foundation 88 are mounting apertures 94 in which the appropriate structure components 96 can be inserted and secured. The structure components 96 feature assembly post ends 98 that are sized such to press into and provide a friction fit within the mounting apertures 94. Structure accessory components 100 also feature assembly post ends 98 that fit into mounting apertures 94. The mounting apertures 94 are formed within raised accessory protrusions 102 integrally molded to the foundation 88 that further enhance the realistic appearance of the foliage assemblies 90 and accessory component 100 when fitted together. Foliage assemblies 90 comprise a mounting base 106 that features an assembly post end 98 as found in other structure accessory components 100. As presented in the gas station and convenience mart example, structure assemblies 24 that represent buildings feature light emitting diode (LED) assemblies 108 integrated into structure assembly 24 components. Each LED assembly 108 features at least one light emitting diode 110 and a base 112. The circuit for the LED assemblies 108 is wired at manufacture. The common construction standard to the LED assemblies 108 in buildings for the play system 1 includes a LED assembly mounting deck 114 to which the base 112 of the LED assembly 108 is affixed to and wired. The light-emitting end of the diodes 110 is positioned such that the unobstructed light direction is perpendicular to the bottom face of the LED deck 114. As with the base mat 88, the LED deck 114 also features mounting apertures 94 to receive additional post ends 98 featured at the top end of the structure components 96. The underside of a roof component 116 is made to receive the LED deck 114. Positive and negative leads from the wired LED circuit are connected to corresponding contacts featured as part of a battery compartment 118 that is integrally molded within the top face of the roof component 116. A battery compartment lid 120 fits into the top edge of the battery compartment 118 and is secured with a screw 122. Batteries 124 are placed into the battery compartment to power the circuit. A switch or lever 126 protrudes from the top surface of the fastened battery compartment lid 120 and is made to toggle back and forth to open and close the circuit, turning the LED assemblies 108 off and on. Side building assembly panels 128 feature clear windows to allow light to pass through, providing the play system 1 yet a further sense of realism.

As with the above road segments 11, the foundation 88 may also be fabricated from elastomer materials or closed and open cell foam materials to include, but are not limited to, polyurethane, vinyl, neoprene, EPDM (ethylene-propylene-diene monomer), rubber, such as Santoprene rubber, silicone rubber, Buna-N rubber and natural rubber. Polymers, including but not limited to, polystyrene, polyurethane, polycarbonate, polyethylene and polypropylene may be used as alternatives as well. In a preferred embodiment, the structure components 96 and structure accessory components 100 are molded from a rigid polystyrene plastic. Other rigid and semi-rigid plastic materials that can be used include, but are not limited to, polyurethane, acrylic, polycarbonate, polyethylene and polypropylene. Rigid and flexible foams as well as solid elastomer plastic can also be used. These include, but would not be limited to, polyurethane, vinyl, neoprene, EPDM (ethylene-propylene-diene monomer), Santoprene rubber, silicone rubber, Buna-N rubber and natural gum rubber. Preferred surface details molded into the structure components 96 and structure accessory components 100 can alternatively be flat printed representations as well.

Figure 19:
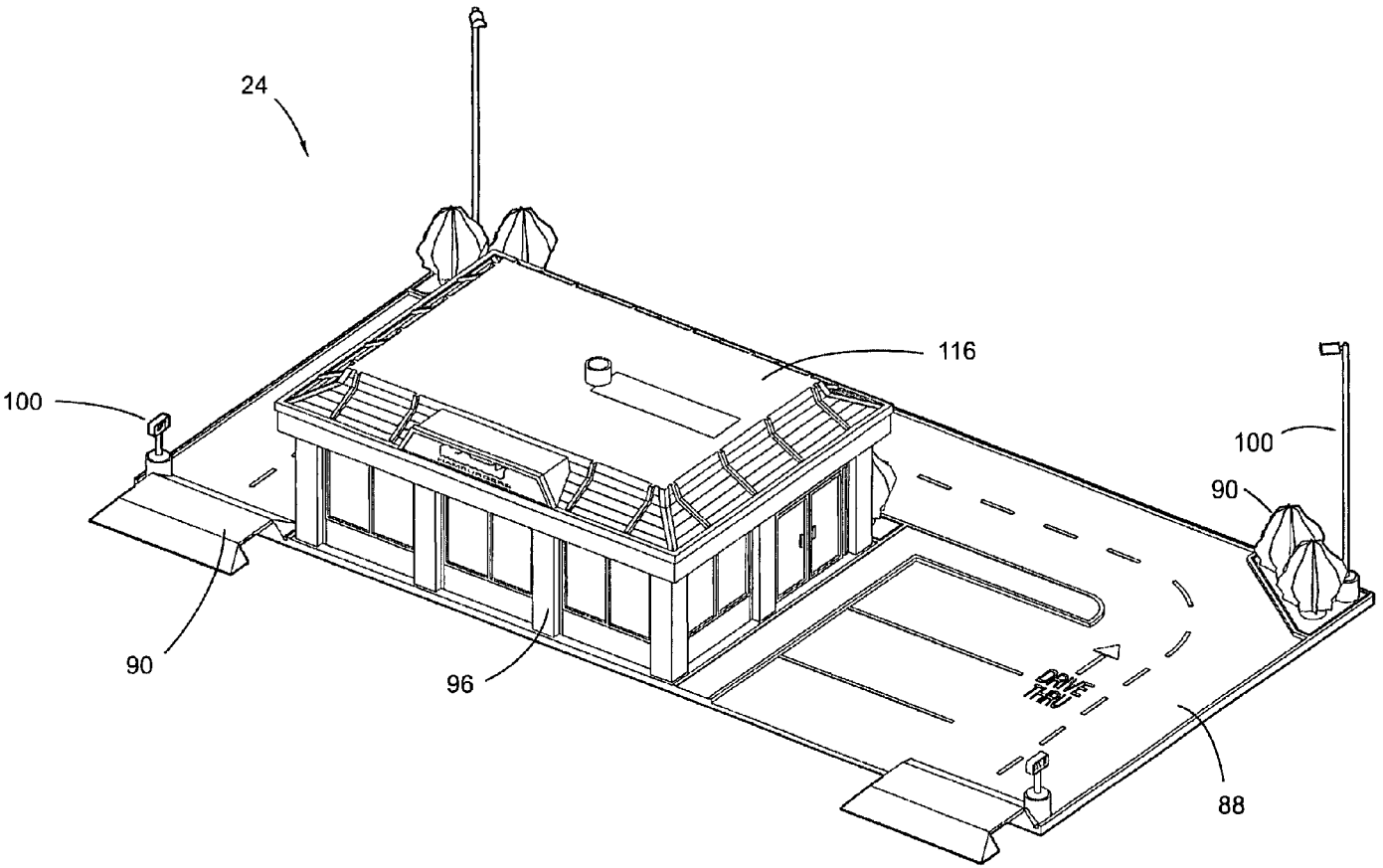
FIG. 19 is a top perspective view of an assembled second building accessory in FIG. 1.

A second example of a structure assembly is illustrated in FIG. 19. In this example, an assembled drive-through restaurant is shown and illustrates the assembled standardized construction and component types as presented in the above gas station and convenience mart example including a foundation 88 having integral ramps 89, structure components 96, roof component 116 featuring LED lighting, foliage assemblies 90 and other supporting accessory components 100.

Figure 20:
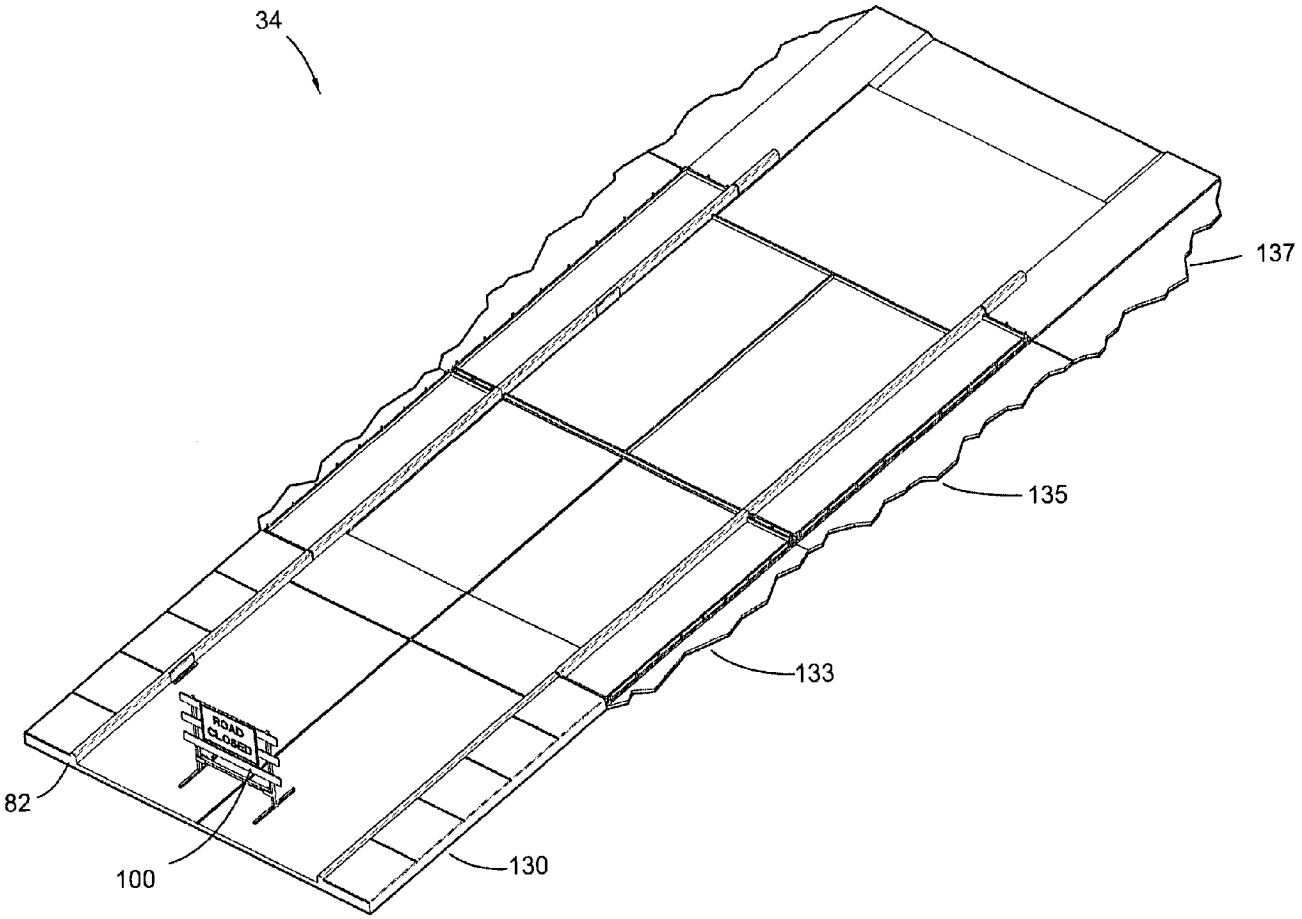
FIG. 20 is a top perspective view of an assembled roadway construction accessory in FIG. 1.
Figure 21:
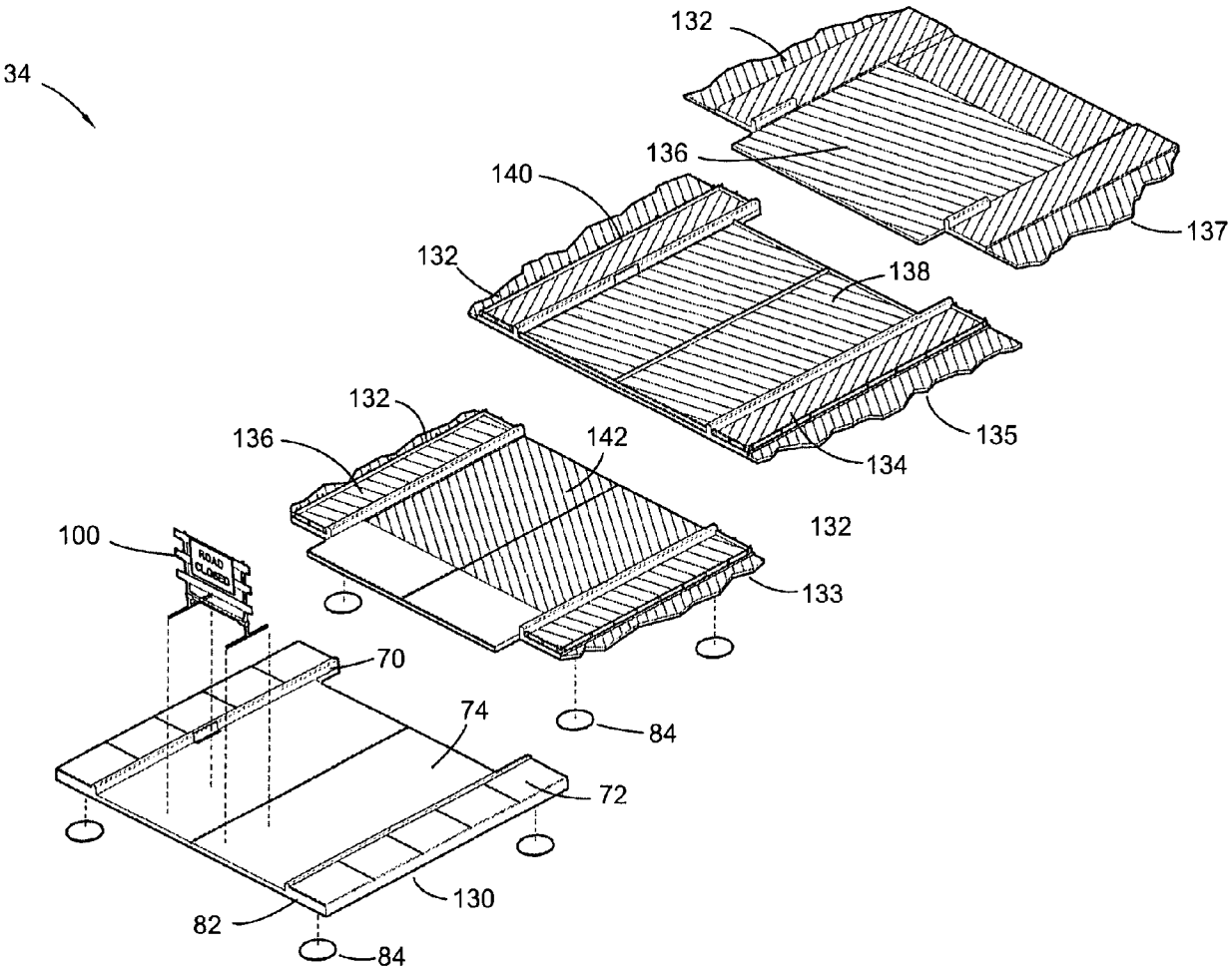
FIG. 21 is an exploded perspective view of the roadway construction accessory in FIG. 20.

Referring to FIG. 20 and FIG. 21, a roadway infrastructure assembly 33 is shown. The magnetization of the play surface base mat 10 is further utilized for placement of roadbed construction segments that are textured and detailed to represent different construction phases of the aforementioned roadway segments 11. Shown are construction roadway segments 130, 133, 135 and 137. Textures and details include overturned earth 132, grated earth 134, gravel 136, gravel and rebar 138, concrete forms 140 and poured concrete 141. The completed roadbed end of the roadway construction assembly 24 features the common end profile 82. Although only straight segments are illustrated, curved segments and intersections are preferred embodiments of the roadway construction assembly 24 as well, providing for a variety of arrangements to be achieved with the aforementioned roadway segments. Material and manufacture of the roadbed construction segments 130 can also be the same as the above roadway segments, and preferably include positioning elements 84, magnetic and/or magnetically attractable, located in a recess of the base surface of the roadway segment that attract to the play surface base mat 10 to securely position the segments. The roadway construction assembly 34 features foliage assemblies 90 and appropriate structure accessory components 100 for a further sense of realism. An example road closed sign is shown and other preferred examples of structure accessory components 100 can include detour signs, construction barrels, various water and sewer pipes, surveying equipment and construction vehicles.

Figure 22:
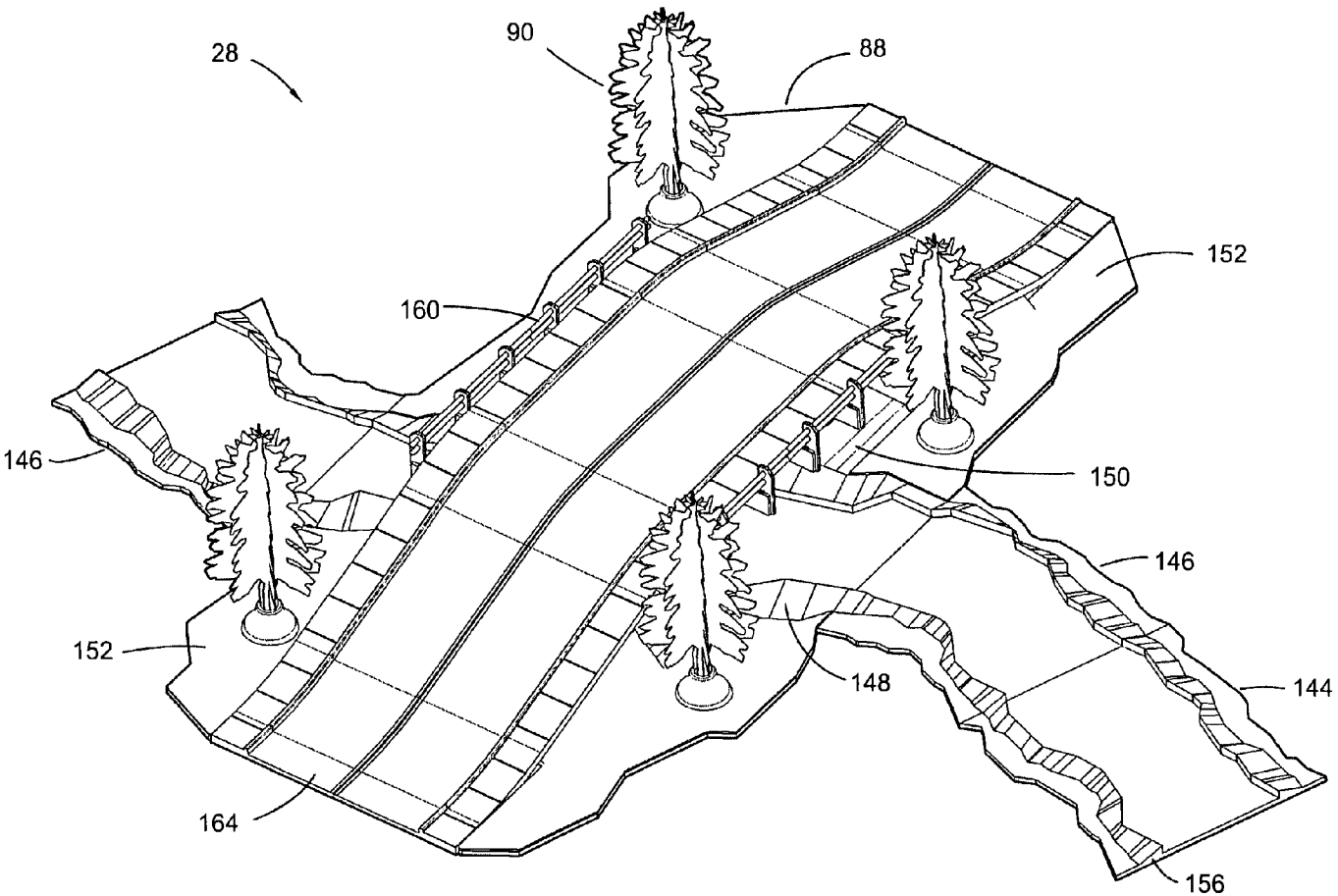
FIG. 22 is a top perspective view of the assembled roadway infrastructure and natural terrain accessory in FIG. 1.
Figure 23:
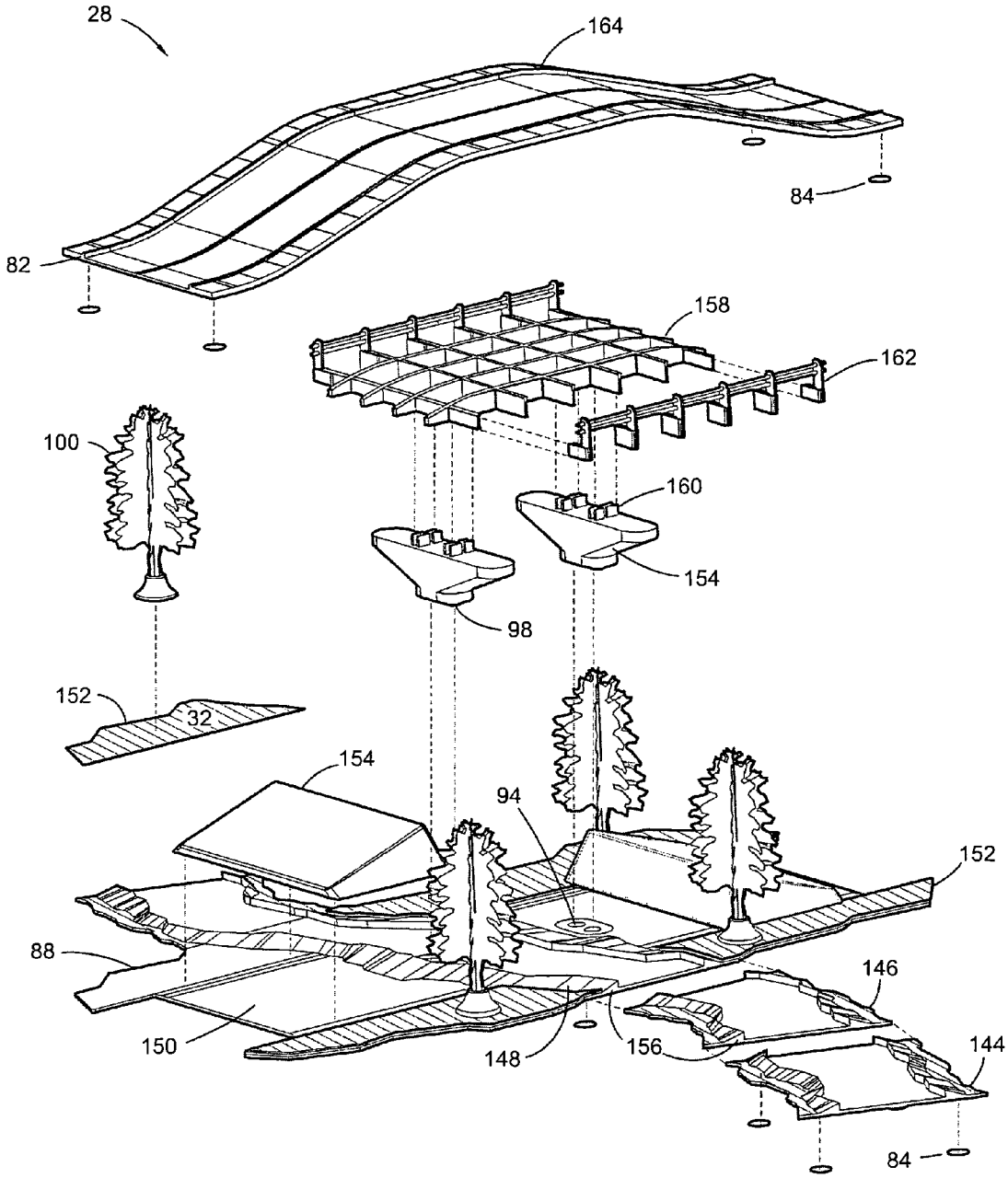
FIG. 23 is an exploded perspective view of the roadway infrastructure and natural terrain accessory in FIG. 22.

Referring to FIG. 22 and FIG. 23, a roadway infrastructure and natural terrain assembly 28 is shown in assembled perspective and exploded views, respectively. The illustrated example includes a contemporary bridge structure 142 and a continuous stream created from straight stream segments 144 and curved stream segments 146. Like the aforementioned road segments 11, the straight 144 and curved 146 stream segments can be arranged in a multitude of configurations. Other preferred examples of roadway infrastructures and natural terrain assemblies 28 include different types of bridges and tunnels traversing other natural and man made terrains such as roadway and interstate overpasses. As with the building structure above, a foundation 88 serves as the platform to which all components of the roadway bridge and natural terrain assembly are to be assembled onto. Similar to the structure assembly 24, the infrastructure and natural terrain assembly 28 of foundation 88 is to be preferably molded from an elastomer material. In the bridge and stream example shown, surface details and textures, including a running stream rock bed 148 and gravel bridge pillar foundation 150, are integrally molded to the top surface of the base mat 10 and are preferably scaled to 1:64 representations of corresponding full size features. The rock bed texture 148 and gravel foundation texture 150 are painted or printed with the appropriate colors of the represented surfaces to further add a sense of realism to the playset system 1. These colors can alternatively be achieved through a co-molding process of colored plastic as well. Foundation 88 of the assembly 28 includes a bottom surface having one or more magnetic elements or magnetically attractable elements that magnetically connect the assembly 28 to a base mat 10. In the bridge and stream example shown, the top face of the vinyl layer 40 is printed with a high-resolution image and pattern of tall grass. The magnetic sections 152 are adhered to the foundation 88 with the magnetic side and printed vinyl layer 40 facing upward. This construction technique enables magnetic attraction of the top, upper surface of the magnetic sections 152 through the printed vinyl layer 40. The magnetic sections 152 serve to provide a magnetized surface on which foliage assemblies 90, such as trees, can be securely placed. Integrally molded within the foundation 88 are mounting apertures 94 in which the appropriate infrastructure support components 154 can be secured by inserting featured post ends 98. The post ends 98 are sized such to press into and provide a friction fit within the mounting apertures 94.

A bridge girder portion 158 is made to fit into ribs 160 integral to the infrastructure support components 154 depicting concrete support columns. Molded side rails 162, see FIG. 23, press over side ends of the girder portion 158 and serve to cradle an extended roadway segment 164. Each end of the extended roadway segment 164 features the end profile 82 mentioned in the roadway segments 11.

The straight stream segment 144, curved stream segment 146 and extended roadway segment 164 are preferably molded from an elastomer material as well. The stream rock bed texture 148 featured on the foundation 88 is also featured on both the straight stream 144 and curved stream 146 segments. Both ends of the straight stream 144 and curved stream 146 segments share a matching profile 156. As with the standard roadway segments 11, both straight 144 and curved 146 stream segments can be turned end to end to form numerous configurations. The matching profile 156 is also featured on the foundation 88 side edges to receive the stream segments.

Magnetized or magnetically attractable positioning elements 84 are located strategically on the bottom side of the foundation 88, straight 144 and curved 146 stream segments close to the periphery to secure from movement on the play surface base mat 10 and maintain a tight placement seam.

As with the road segments 11, the foundation 88 may also be fabricated from elastomer materials or closed and open cell foam materials to include, but are not limited to, polyurethane, vinyl, neoprene, EPDM (ethylene-propylene-diene monomer), Santoprene rubber, silicone rubber, Buna-N rubber and natural gum rubber. Rigid plastic including, but not limited to, polystyrene, polyurethane, polycarbonate, polyethylene and polypropylene may be used as alternatives as well. In a preferred embodiment, the infrastructure support components 154, bridge girder portion 158, side rails 162 and supporting assembly accessory components 100 are molded from rigid polystyrene plastic. Other rigid and semi-rigid plastic materials that can be used include, but are not limited to, polyurethane, acrylic, polycarbonate, polyethylene and polypropylene. Rigid and flexible foams as well as solid elastomer plastic can also be used. These include, but would not be limited to, polyurethane, vinyl, neoprene, EPDM (ethylene-propylene-diene monomer), Santoprene rubber, silicone rubber, Buna-N rubber and natural gum rubber. Preferred surface details molded into the infrastructure components 154 can alternatively be flat printed representations as well.

Figure 24:
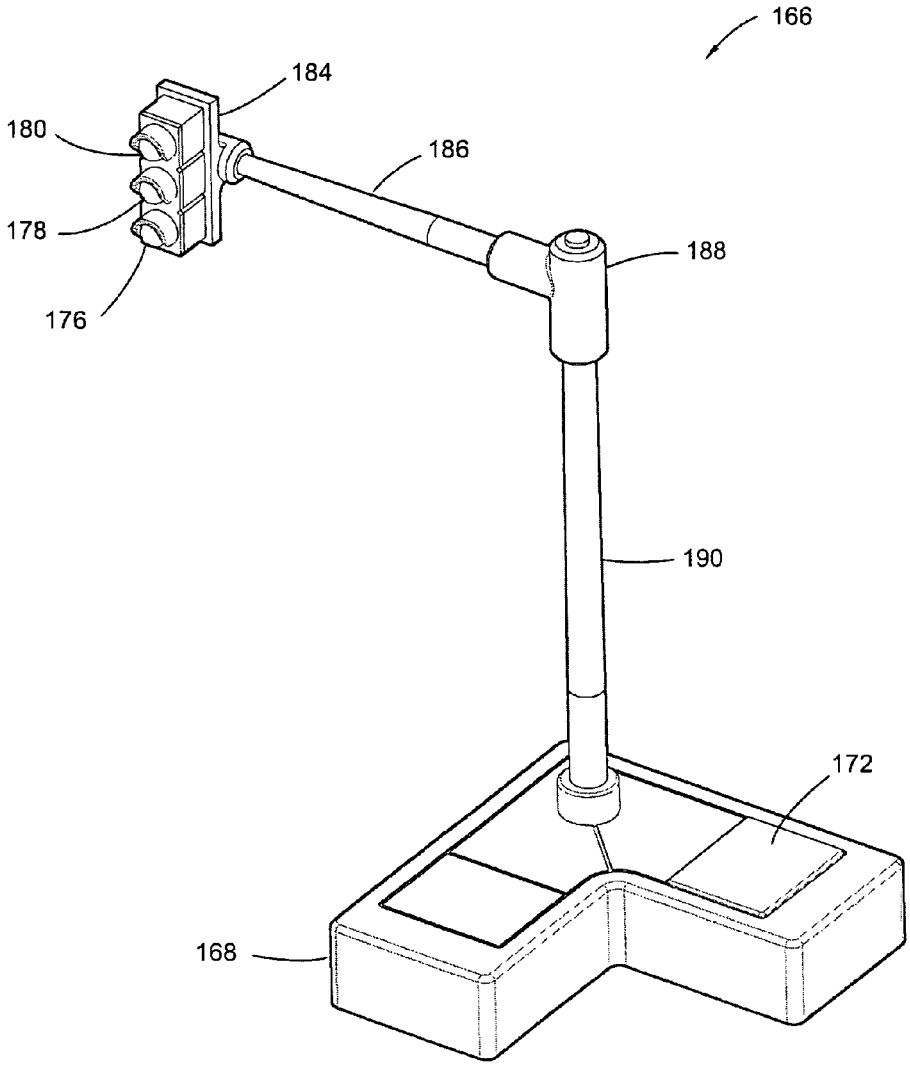
FIG. 24 is a top perspective view of an interactive, illuminated stoplight accessory.
Figure 25:
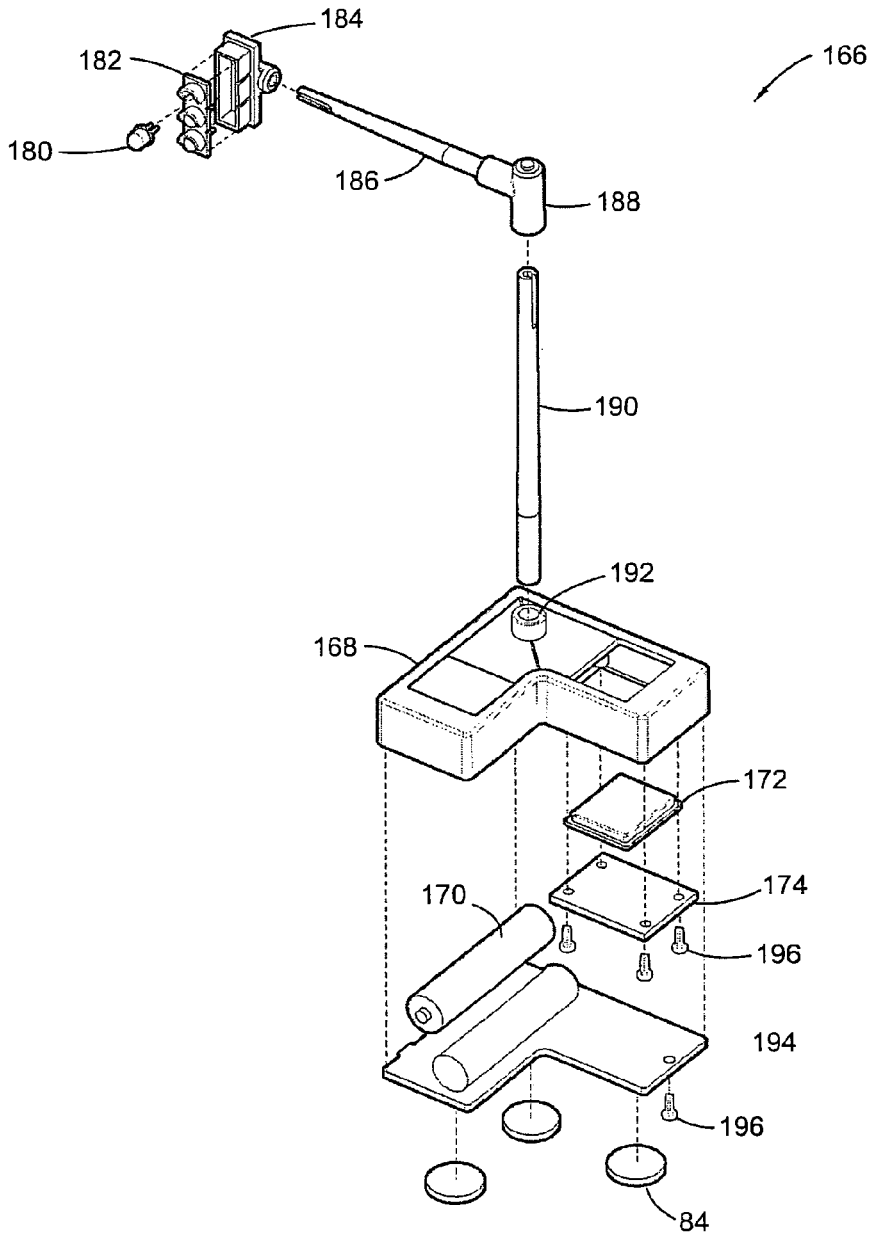
FIG. 25 is an exploded perspective view of the stoplight accessory in FIG. 24 detailing inside components and construction.

Referring to FIG. 24 and FIG. 25, an interactive stoplight accessory 166 is shown as an example of interactive technologies to be incorporated into the playset system 1. A bottom housing 168 is molded from rigid plastic. Standard battery contacts are installed within, and the bottom housing 168 sized such to accommodate batteries 170. A push button switch 172 is interfaced with appropriate electronic components populating a PC board 174, attached with screws 196 to the bottom housing 168. The functioning push button switch 172 and PC board 174 interface allow for a variety of ways to illuminate a green light emitting diode (LED) 176, a yellow LED 178 and a red LED 180. Said LEDs mount into and are affixed to a stoplight housing cap 182 that is affixed to a stoplight housing 184. The stoplight housing 184 is attached to a horizontal pole 186. One end of pole elbow 188 is affixed to the end of the horizontal pole 186 opposite the stoplight housing 184. The other end of the pole elbow 186 is affixed to the top end of a vertical pole 190. The lower end of the vertical pole 190 attaches to a receiving collar 192 integral to the top face of the bottom housing 168. The horizontal pole 186, pole elbow 188 and vertical pole 190 are hollow to accommodate wiring running from the bottom housing 168 to the aforementioned LEDs. Positioning elements 84 are affixed to receiving details in the bottom surface of bottom housing cover 194, and serve to hold the accessory 166 in place on the play surface base mat 10. The bottom housing cover 194 attaches to the bottom housing 168 with a screw 196, allowing for replacement of the batteries 170.

Figure 26:
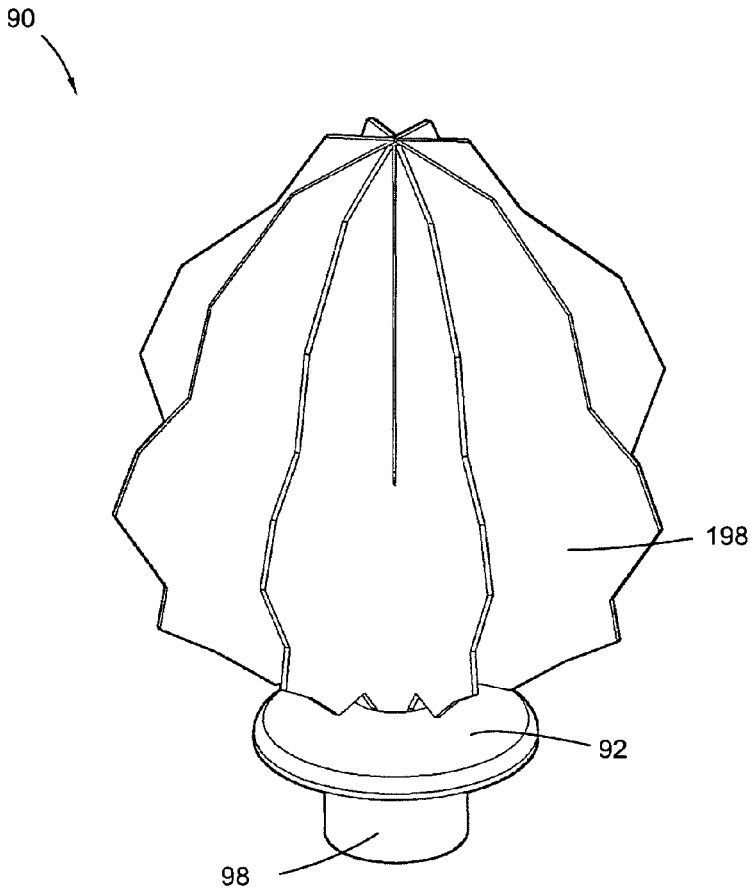
FIG. 26 is a top perspective view of a bush accessory.
Figure 27:
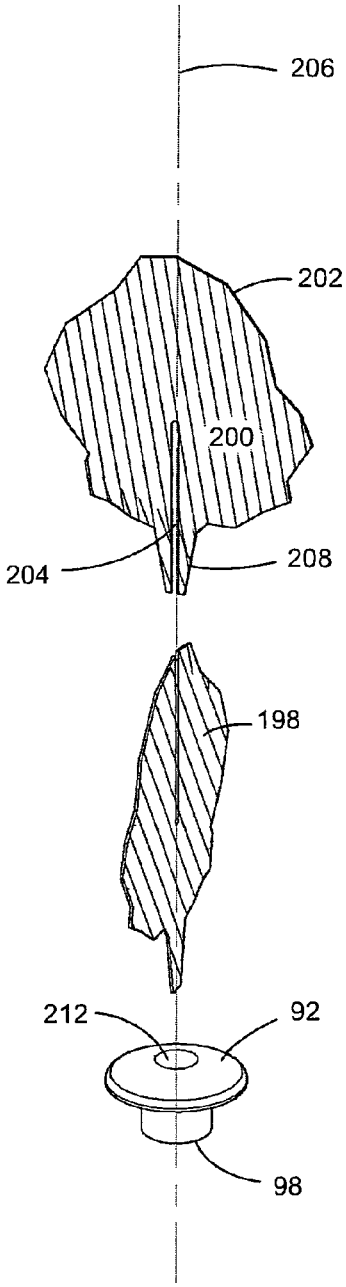
FIG. 27 is an exploded perspective view of the bush accessory in FIG. 26 showing the preferred construction to be standard to the playset natural foliage.
Figure 28:
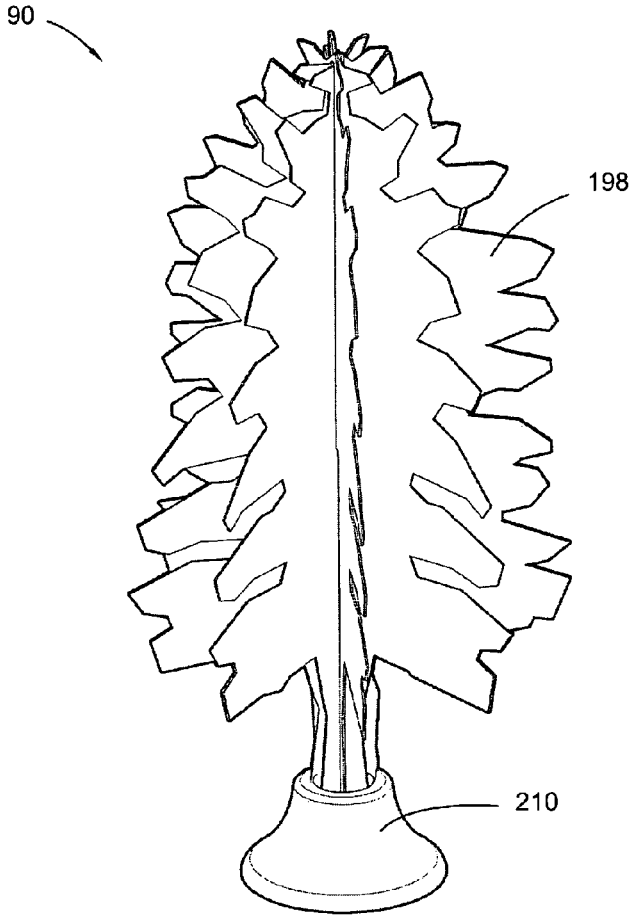
FIG. 28 is a top perspective view of a tree accessory.
Figure 29:
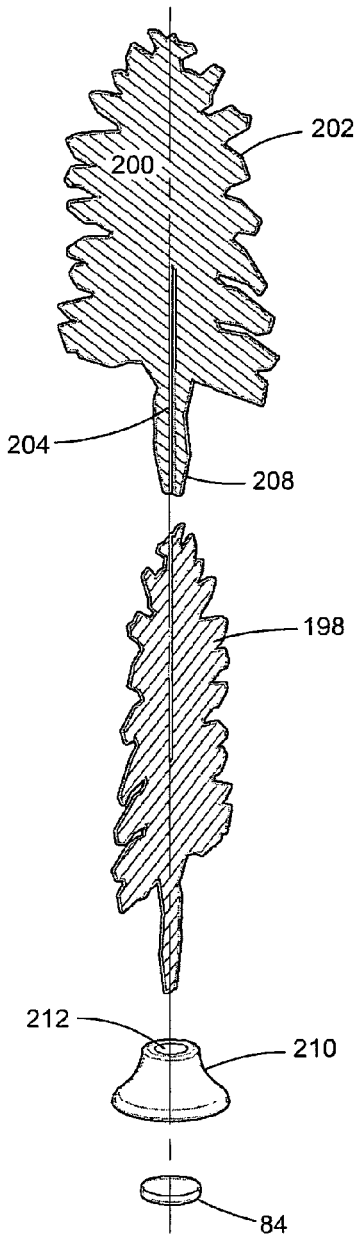
FIG. 29 is an exploded perspective view of the tree accessory including a magnetic base feature.

Referring to FIG. 26 through FIG. 28, foliage assemblies 90 are shown in further detail. Preferably, plastic laminated cards 198 are printed with a variety of foliage patterns 200 and die-cut shapes 202. The foliage patterns 200 and die-cut shapes 202 are printed and profiled to represent a multitude of different species of bushes and trees. Shapes 202 can also be made from printed or colored rigid and semi-rigid plastics such as polystyrene or polyethylene. Cellular and non-cellular plastics and rubbers may also be used. In the preferred embodiment shown, the laminated cards 198 feature middle slots 204 that alternate from top to bottom on a vertical axis 206. The slots 204 on the laminated cards 198 insert together to display angled profiles. More laminated cards 198 can be added to achieve a variety of affects. A bottom tip profile 208 is designed into the laminated cards 198, and sized to fit into the post-end foliage base 92 and a free standing foliage base 210. The foliage patterns and die-cut shapes 202 may or may not be identical. The bottom tip profile 208 is sized to friction fit into a hole 212 featured in the post-end foliage base 92 and free standing foliage base 210. A positioning element 84 is affixed within a pocket in the bottom face of the foliage assembly base 210 and serves to securely position the foliage assembly 90 on the play surface base mat 10 and sheet magnetic sections 152.

The present invention has been described in detail with reference to the preferred embodiments. It is apparent that certain changes and modifications may be made without departing from the spirit and scope of the present invention. It is intended that all matter contained in the above description or shown in the accompanying drawings shall be interpreted as illustrative and not in a limited sense.

What is claimed is:

1. A playset system with multiple configuration possibilities, comprising:

a base mat having a length and a width, the base mat having an upper surface and a lower surface adapted to be disposed on a substrate, the base mat comprising at least three layers including a top layer, a middle layer and a bottom layer comprising a foamed polymer, wherein the middle layer comprises cardboard, rigid foam, foam core, polystyrene, polyethylene, polycarbonate, acrylic or a urethane, or a combination thereof, wherein the top layer includes one or more of a plurality of magnetic elements and magnetically attractable elements, wherein the top layer is connected to the middle layer and the middle layer is connected to the bottom layer; and two or more separate and distinct roadway segments each having an upper surface, a lower surface and a side surface located between the upper surface and lower surface, the lower surface including one or more of a plurality of magnetic elements and magnetically attractable elements, wherein the two or more roadway segments are directly connectable to the base mat via magnetic attraction with the lower surface of the two or more roadway segments being magnetically connectable to and in direct contact with the upper surface of the base mat, wherein the side surfaces of the two or more roadway segments are abuttable to provide continuity between road features of the two or more roadway segments, and wherein the length and width of the base mat form an area greater than an area of at least two of the roadway segments.

2. The playset system according to claim 1, wherein the side surfaces of the two or more roadway segments each have an edge profile comprising a curb having a height greater than the height of a roadway, said height measured on the side surface between the roadway segment lower surface and the upper surface, wherein the curb of one roadway segment contacts the curb of another roadway segment, and wherein the roadway of one roadway segment contacts the roadway of another roadway segment to provide said continuity between adjacent roadway segments.

3. The playact system according to claim 1, wherein the two or more roadway segments each include a recess in the lower surface and a positioning element is connected in the recess, and wherein the positioning element comprises the one or more of the magnetic elements and magnetically attractable elements.

4. The playact system according to claim 3, wherein the positioning element is a disc that is steel, a flexible magnetic sheet or a magnet, and wherein said disc is mounted substantially flush to the bottom surface of the roadway segment.

5. The playset system according to claim 1, wherein said top layer comprises a vinyl layer connected to a magnetic layer, wherein said magnetic layer comprises magnetic particles and a polymer.

6. The playset system according to claim 5, wherein the vinyl layer comprises indicia on the exposed, upper surface.

7. The playset system according to claim 1, wherein at least two base mats are present and are connected by a connector element.

8. The playset system according to claim 7, wherein each base mat has a side surface located between the upper surface and the lower surface, and wherein the connector element connects the side surface of one base mat to the side surface of another base mat.

9. The playset system according to claim 8, wherein the two or more base mats each have at least three side surfaces, and wherein at least one side surface of each base mat includes one or more of a plurality of magnetic elements and magnetically attractable elements.

10. The playact system according to claim 8, wherein the connector element is a peg, disc or biscuit, or a combination thereof.

11. The playset system according to claim 2, wherein at least one of the two or more roadway segments comprises a straight roadway segment and an additional roadway segment comprises a curved roadway segment, an intersecting roadway segment, or an angled roadway segment.

12. The playact system according to claim 1, wherein the playact further includes a structure assembly, and wherein the structure assembly is connected to a roadway segment by a ramp that comprises a notch that secures a foundation of the structure assembly to a curb of the roadway segment.

13. A playset system with multiple configuration possibilities, comprising:

a first base mat and a second base mat each having a length and a width, each base mat having an upper surface and a lower surface, each lower surface adapted to be disposed on a substrate, each base mat having three or more side surfaces between the upper surface and the lower surface, the first base mat having a side surface having a length substantially equal to a length of a side surface of the second base mat and a connector element connectable to said substantially equal length side surfaces, the first base mat and second base mats connected by the connector element, wherein the first and second base mats each include at least two layers, wherein one of the layers is a top layer including said base mat upper surface, wherein said top layer comprises a vinyl layer connected to a magnetic layer, wherein said magnetic layer comprises magnetic particles and a polymer; wherein another of the layers is a bottom layer comprising a foam, the bottom layer directly connected to the top layer; and a first roadway segment and a second roadway segment, each having an upper surface and a lower surface, the lower surface of the first and second roadway segments including one or more of a plurality of magnetic elements and magnetically attractable elements, wherein the first and second roadway segments are directly connectable to the first and second base mats through magnetic attraction of the lower surface of the roadway segments and the upper surface of the base mat, wherein the first roadway segment has a side surface matable with a side surface of the second roadway segment to provide continuity between roadway features of the first and second roadway segments.

14. The playset system according to claim 13, wherein the side surfaces of the first and second roadway segments each have an edge profile comprising a curb having a height greater than the height of a roadway, said height measured on the side surface between the roadway segment lower surface and the upper surface, wherein the curb of the first roadway segment contacts the curb of the second roadway segment, and wherein the roadway of the first roadway segment contacts the roadway of the second roadway segment to provide said continuity between the first and second roadway segments.

15. The playact system according to claim 13, wherein the first and second roadway segments each include a recess and a positioning element is connected in the recess, wherein the positioning element comprises the one or more of the magnetic elements and magnetically attractable elements, wherein the positioning element is a disc that is steel, a flexible magnetic sheet or a magnet, and wherein said disc is mounted substantially flush to the bottom surface of the first and second roadway segments.

16. The playset system according to claim 13, wherein the first and second base mats comprise at least three layers including the top layer, a middle layer and the bottom layer comprising foam polymer, wherein the middle layer comprises cardboard, rigid form, foam core, polystyrene, polyethylene, polycarbonate, acrylic or a urethane, or a combination thereof, and wherein the vinyl film comprises indicia on the exposed, upper surface.

17. The playset system according to claim 16, wherein at least the side surface of each base mat includes one or more of a plurality of magnetic elements and magnetically attractable elements, and wherein the connector element is a peg, disc or biscuit, or a combination thereof, and wherein a total area of the first base mat and second base mat is greater than an area of a total area of the first roadway segment and second roadway segment.

18. The playset system according to claim 14, wherein the first roadway segment comprises a straight roadway segment and the second roadway segment comprises a curved roadway segment, an intersecting roadway segment or an angled roadway segment.

19. The playset system according to claim 13, wherein the playset further includes a structure assembly, and wherein the structure assembly is connected to the first roadway segment or the second roadway segment by a ramp that comprises a notch that secures a foundation of the structure assembly to a curb of the roadway segment.

20. A playset system for toy vehicles comprising:

a plurality of magnetic base mats of geometric shapes having at least one side surface having a common length or a length divisible to the common length to allow for the mats to be contiguously placed in a multitude of configurations, at least one side surface of each mat including at least one aperture therein, wherein the base mat layered construction includes a top magnetic layer, a rigid middle layer and a bottom foam layer, wherein the top layer is connected to the middle layer and the middle layer is connected to the bottom layer;

a plurality of coupler components, each component having a middle stop and a barbed peg receivable in said aperture, whereby inserted into each recess, the component serves to interlock two of the base mats;

a plurality of separate and distinct roadway segments having a common side surface profile, the roadway segment having at least one positioning disc substantially flush to a bottom surface of the roadway segment, whereby allowing for placement of the roadway segments on the base mats in a multitude of end to end configurations while securing the roadway segment to the base mats with magnetization that directly connects the bottom surface of the roadway segments to the top magnetic layer of the base mat wherein the area of the plurality of magnetic base mats is greater than an area of the plurality of roadway segments; and a plurality of structure assemblies featuring a foundation including a positioning element and a ramp connectable with at least one said roadway segment.

21. The playset system according to claim 20, wherein a polymer containing magnetic particles is used as the top magnetic layer and is adhered to said middle rigid layer with the top layer comprising a magnetic surface facing upward and a vinyl film with printed graphic adhered over it.

22. The playset system according to claim 20, wherein said roadway segments include one or more of a straight, a partially straight, a curve, a ninety degree turn, a three-way intersection and a four-way intersection featuring positioning elements in the bottom face, whereby the magnetic attraction of the base mat top surface to the positioning elements serves to hold the roadway segments in place.

23. The playset system according to claim 20, wherein said structure assembly foundation features said positioning elements in the bottom face, whereby the magnetic attraction of the play mat top surface to the positioning elements serves to hold the structure assemblies in place.

24. The playact system according to claim 20, wherein a plurality of interactive lighting accessories feature user interface components such as levers and buttons for activation, and wherein said lighting accessories feature light emitting diodes that further enhance a sense of realism and imaginative play.

* * * * *